US010966578B2

(12) United States Patent
Zimmermann et al.

(10) Patent No.: US 10,966,578 B2
(45) Date of Patent: Apr. 6, 2021

(54) HOLDING ARRANGEMENT AND METHOD FOR HOLDING A TISSUE ROLL IN A DISPENSER, AND DISPENSER

(71) Applicant: CWS-boco International GmbH, Duisburg (DE)

(72) Inventors: Christoph Zimmermann, Birkenau (DE); Markus Rückheim, Griesheim (DE)

(73) Assignee: CWS INTERNATIONAL GmbH, Duisburg (DE)

( * ) Notice: Subject to any disclaimer, the term of this patent is extended or adjusted under 35 U.S.C. 154(b) by 0 days.

(21) Appl. No.: 16/524,615

(22) Filed: Jul. 29, 2019

(65) Prior Publication Data

US 2020/0029752 A1 Jan. 30, 2020

(30) Foreign Application Priority Data

Jul. 30, 2018 (EP) ..... 18186308

(51) Int. Cl.
*A47K 10/40* (2006.01)
*A47K 10/36* (2006.01)
*A47K 10/38* (2006.01)

(52) U.S. Cl.
CPC ..... *A47K 10/405* (2013.01); *A47K 10/36* (2013.01); *A47K 2010/3854* (2013.01)

(58) Field of Classification Search
CPC ..... A47K 10/405; A47K 10/36; A47K 2010/3854; A47K 10/40; A47K 2010/3253; A47K 10/3827; A47K 10/3687; A47K 10/38; A47K 2010/3681
See application file for complete search history.

(56) References Cited

U.S. PATENT DOCUMENTS 2,410,328 A 10/1946 Agamite, Jr.
2,620,991 A * 12/1952 Deffenbaugh ..... A47F 1/08 242/560.3
2,896,871 A * 7/1959 Woodruff ..... A47K 10/22 242/560.3

(Continued)

FOREIGN PATENT DOCUMENTS

DE 2952729 7/1981
EP 2299887 3/2011

(Continued)

*Primary Examiner* — William A. Rivera
(74) *Attorney, Agent, or Firm* — Price Heneveld LLP

(57) ABSTRACT

A holding arrangement for holding a tissue roll in a dispenser, to a dispenser and a method is disclosed. The holding mechanism comprises a holding mechanism for holding a tissue roll in a first tissue roll position; wherein the holding mechanism comprises a first holding element for engaging a first end of an axle of the tissue roll and a second holding element for engaging a second end of the axle of the tissue roll; a diameter sensor; and a shift mechanism adapted for shifting the holding mechanism, in particular the first and second holding elements, from a hold position to a release position and vice versa; wherein a distance between the first holding element and the second holding element in the release position is larger than a distance between the first holding element and the second holding element in the hold position.

12 Claims, 23 Drawing Sheets

(56) References Cited

U.S. PATENT DOCUMENTS

| | | | | | |
|---|---|---|---|---|---|
| 3,039,709 | A | * | 6/1962 | Bolger | A47K 10/32 242/560.3 |
| 3,437,388 | A | * | 4/1969 | Jespersen | A47K 10/40 242/596.7 |
| 4,034,924 | A | * | 7/1977 | Carlisle | A47K 10/40 242/560.3 |
| 4,383,657 | A | * | 5/1983 | Suh | A47K 10/40 242/560.3 |
| 4,522,346 | A | * | 6/1985 | Jespersen | A47K 10/40 242/560.3 |
| 5,000,393 | A | | 3/1991 | Madsen | |
| 7,828,240 | B2 | | 11/2010 | Hagleitner | |
| 9,524,604 | B2 | | 12/2016 | Erb | |
| 2003/0167893 | A1 | | 9/2003 | Morris et al. | |
| 2008/0245922 | A1 | | 10/2008 | Fellhoelter | |
| 2017/0188760 | A1 | | 7/2017 | Henson et al. | |

FOREIGN PATENT DOCUMENTS

| | | |
|---|---|---|
| EP | 2366316 | 9/2011 |
| EP | 2810259 | 12/2014 |
| EP | 2816941 | 12/2014 |
| EP | 2816942 | 12/2014 |
| EP | 3295851 | 3/2018 |
| WO | 2005006932 | 1/2005 |
| WO | 2009135241 | 11/2009 |
| WO | 2010046662 | 4/2010 |
| WO | 2013113129 | 8/2013 |
| WO | 2013123535 | 8/2013 |
| WO | 2013123536 | 8/2013 |
| WO | 2015066644 | 5/2015 |
| WO | 2015166034 | 11/2015 |
| WO | 2016015067 | 2/2016 |
| WO | 2017193151 | 11/2017 |

* cited by examiner

HOLDING ARRANGEMENT AND METHOD FOR HOLDING A TISSUE ROLL IN A DISPENSER, AND DISPENSER

CROSS-REFERENCE TO FOREIGN PRIORITY APPLICATION

The present application claims the benefit under 35 U.S.C. §§ 119(b), 119(e), 120, and/or 365(c) of European Application No. EP 18186308.5 filed Jul. 30, 2018.

FIELD OF THE INVENTION

The invention relates to a holding arrangement for holding a tissue roll in a dispenser, to a dispenser for dispensing portions of a continuous web of tissue from a tissue roll, and a method for holding a tissue roll in a dispenser.

BACKGROUND OF THE INVENTION

The main application area for such dispensers are washrooms and other hygienic environments. Dispensers and methods for dispensing portions of a continuous web of tissue from a tissue roll are known, for example, from WO 2015/166034 A1, WO 2009/135241 A2, WO 2010/046662 A1, WO 2017/193151 A1, EP 2 816 941 B1, EP 2 816 942 B1, EP 3 295 851 A1, EP 2 299 887 B1, WO 2016/015067 A1, WO 2013/123535 A2, U.S. Pat. No. 7,828,240 B2, WO 2005/006932 A1, EP 2 366 316 B1, WO 2013/113129 A1.

Existing solutions, however, have a number of drawbacks. For example, providing a dispenser with a refill of a tissue roll and/or providing enough tissue capacity within a dispenser for a high number of users is a challenge. Further, the amount of time service personnel spends when servicing a dispenser, for example, by exchanging, removing, and/or refilling tissue rolls, is long, since often complex tasks have to be carried out, which often cannot be carried out easily and/or reliably. Further, efficient solutions with regard to costs, time, and/or resource usage are sought.

SUMMARY OF THE INVENTION

Therefore, it is an object of the present invention to provide an improved holding arrangement for holding a tissue roll in a dispenser, an improved dispenser for dispensing portions of a continuous web of tissue from a tissue roll, and an improved method for holding a tissue roll in a dispenser. In particular, it is an object of the present invention to provide a holding arrangement for holding a tissue roll in a dispenser, a dispenser for dispensing portions of a continuous web of tissue from a tissue roll, and a method for holding a tissue roll in a dispenser, which reduce or eliminate one or more of the above-mentioned disadvantages. Further, it is an object of the present invention to provide a holding arrangement for holding a tissue roll in a dispenser, a dispenser for dispensing portions of a continuous web of tissue from a tissue roll, and a method for holding a tissue roll in a dispenser, which are reliable and/or efficient.

According to a first aspect, it is provided a holding arrangement for holding a tissue roll in a dispenser for dispensing portions of a continuous web of tissue from a tissue roll, the holding mechanism comprising a holding mechanism for holding a tissue roll in a first tissue roll position; wherein the holding mechanism comprises a first holding element for engaging a first end of an axle of the tissue roll and a second holding element for engaging a second end of the axle of the tissue roll; a diameter sensor for detecting the diameter of a tissue roll in the first tissue roll position; and a shift mechanism connecting the holding mechanism and the diameter sensor; wherein the shift mechanism is adapted for shifting the holding mechanism, in particular, the first and second holding elements, from a hold position to a release position and vice versa; wherein a distance between the first holding element and the second holding element in the release position is larger than a distance between the first holding element and the second holding element in the hold position.

Preferably, the holding arrangement is adapted to releasably hold a tissue roll and to release the tissue roll, as will be described later in detail.

The holding arrangement is suitable for use in a dispenser, which is preferably suitable for washrooms and other hygienic environments. The tissue to be dispensed from the dispenser can be a single use tissue, such as a paper towel, or a multiuse tissue, such as a cloth towel or microfiber towel. The tissue is dispensed in portions, which preferably means a certain length of tissue to be used by a user, often for drying hands. The dispensed portion can be discarded after use, for example, by tearing or cutting the portion from the continuous web of tissue. Alternatively, in multiuse tissue dispensers in particular, the dispensed and used portion of tissue can be retrieved and coiled, for example, within the dispenser. Usually, the used multiuse tissue is removed by service personnel, washed and recycled, and then provided for a further use cycle. Once a tissue roll is empty, usually a new tissue roll, which also can be a recycled tissue roll, is inserted into the dispenser and received there by some form of holding arrangement.

The holding arrangement is suitable for holding a tissue roll in a dispenser. In particular, the holding mechanism is adapted to hold a tissue roll such that the tissue roll can be rotated in a direction of unrolling, such that portions of tissue can be supplied from the continuous web of tissue coiled on the tissue roll. In particular, the holding mechanism is adapted to hold an axle of a tissue roll in a releasable and rotatable manner. The axle of the tissue roll can be a hollow axle or a full axle. The axle of a tissue roll can protrude in an axial direction from the tissue roll at one or both ends of the axle or end flush with the end of the coiled tissue of the tissue roll.

The holding mechanism comprises first and second holding elements for engaging first and second ends of the axle of the tissue roll. For example, a holding element can be in the form of a cylindrical stub for protruding into an end of a hollow axle of the tissue roll. A holding element can also be in the form of a form fit piece into which an end of the axle protruding from the coiled tissue of the tissue roll can be inserted. In general, it is preferred that the engagement between the first and second holding elements of the holding mechanism and the first and second ends of the axle of the tissue roll provides sufficient support to reliably hold the axle of the tissue roll during rotation of the tissue roll in an unrolling direction for supply of tissue. It is particularly preferred that the holding mechanism provides full support of the axle of the tissue roll, which preferably means that no additional elements of the holding arrangement or the dispenser are needed in providing support for and/or guidance for the axle of the tissue roll.

It is particularly preferred that the holding mechanism, in particular, the first holding element and the second holding element, is adapted to provide operative support for the tissue roll during operation of the dispenser, in particular during dispensing of tissue.

Preferably, the first tissue roll position is a receiving position for receiving a new refill tissue roll. In particular, the receiving position for receiving a new tissue roll and the first tissue roll position are identical positions, i.e., no movement of the tissue roll after its insertion into a dispenser by service personnel to a dispensing position for dispensing tissue is needed. Further, preferably, the first tissue roll position remains unchanged during dispensing of tissue from a tissue roll in the first tissue roll position, i.e., while the diameter of the tissue roll in the first tissue roll position is gradually reduced, the tissue roll remains in the first tissue roll position; specifically, there is no movement of the tissue roll into another position or a change of the first tissue roll position.

Preferably, the holding mechanism is adapted to provide full and/or the sole operational support for the tissue roll during operation of the dispenser, in particular during dispensing of tissue.

In general, it is preferred that the engagement between the first and second holding elements of the holding mechanism and the first and second ends of the axle of the tissue roll can be realized, for example, by an engagement of protrusions of the first and second holding elements with respective recesses in the first and second ends of the axle of the tissue roll or by an engagement of recesses of the first and second holding elements with respective protrusions in the first and second ends of the axle of the tissue roll. Further engagement solutions, such as a combination of recesses and protrusion, and/or magnetic connections, are possible.

The holding arrangement further comprises a diameter sensor for detecting the diameter of a tissue roll in the first tissue roll position. Preferably, the diameter sensor is a mechanical sensor adapted to detect the diameter of a tissue roll by contacting the outer periphery of the tissue roll and changing its position with the reduced diameter of the tissue roll, which is reduced by supplying portions of the continuous web of tissue coiled on the tissue roll.

Further, the holding arrangement comprises a shift mechanism connecting the holding mechanism and the diameter sensor. The shift mechanism is adapted to shift the holding mechanism from a hold position to a release position and vice versa. In particular, the shift mechanism is adapted to shift the first and second holding elements from a hold position to a release position and vice versa.

In the hold position, a distance, in particular, a horizontal distance and/or a distance in an axial direction of the tissue roll, between the first and second holding elements is smaller than a distance, in particular, a horizontal distance and/or a distance in an axial direction of the tissue roll, between the first and second holding elements in the release position. The distance between the first and second holding elements in the hold position preferably is dimensioned such that the axle of a tissue roll in the first tissue roll position can be reliably held.

Further, preferably, the distance between the first and second holding elements in the release position is dimensioned such that the axle of the tissue roll is free from contact with the first and/or the second holding element. Preferably, in the release position a distance, in particular, a horizontal distance and/or a distance in an axial direction of the tissue roll, is present between the first holding element and the first end of the axle of the tissue roll and between the second holding element and the second end of the axle of the tissue roll. This way, in particular, since the holding mechanism is the only support for the tissue roll, no support is present for the tissue roll in the release position and the tissue roll is free to fall down under gravity. Preferably, after being held in the first tissue roll position by the holding arrangement in the hold position, the holding arrangement comes into the release position and the tissue roll is released from the first tissue roll position and preferably moves into a second tissue roll position of a dispenser. Preferably, during this movement the axle of the tissue roll, in particular, each end of the axle, is unguided, that is, not guided in a guide rail contacting the axle.

The dispenser is preferably suitable for washrooms and other hygienic environments. The tissue to be dispensed from the dispenser can be a single use tissue, such as a paper towel, or a multiuse tissue, such as a cloth towel. The tissue is dispensed in portions, which preferably means a certain length of tissue to be used by a user, often for drying hands. The dispensed portion can be discarded after use, for example, by tearing or cutting the portion from the continuous web of tissue. The tissue can be perforated at intervals to facilitate tearing or cutting.

Further, specifically in multiuse tissue dispensers, the dispensed and used portion of tissue can be retrieved and coiled within the dispenser. Usually, the used multiuse tissue is removed by service personnel, washed and recycled, and then provided for a further use cycle. Once a tissue roll is empty, usually a new tissue roll, which also can be a recycled tissue roll, is inserted into the dispenser and received there by some form of holding arrangement.

The holding arrangement described herein has several advantages. By holding a tissue roll in the first tissue roll position in a secure and reliable manner, it is possible to supply portions of a continuous web of tissue from the tissue roll in this first tissue roll position and to detect the diameter, in particular, a reduced diameter, of the tissue roll in this first tissue roll position by the diameter sensor. At the same time, by moving the first and second holding elements away from the axle of the tissue roll in the release position by increasing the distance between the first and second holding elements via the shift mechanism, a reliable and preferably full release of the tissue roll from the first tissue roll position is effected. In other words, while the holding elements hold the tissue roll in the first tissue roll position in the hold position, the tissue roll is released for freefall by spacing the holding elements from the tissue roll, in particular, an axle of the tissue roll, in the release position.

The invention is based, inter alia, on the finding that existing solutions often provide guide rails in a dispenser for guiding the movement of a tissue roll by contacting the axle of a tissue roll from an insertion position to a dispensing position. Existing solutions in the guide rails often contain stop elements or the like to temporarily prevent the tissue roll from moving further along the guide rails, and which can be removed from the guide rail to let the tissue roll pass.

Contrary to existing solutions, the solution described herein does not need guide rails and additional stopping elements. Rather, the larger distance between the holding elements in the release position allows the insertion of a refill roll directly into the first tissue roll position, so that the tissue roll does not need to travel from an insertion position to a dispensing position. Rather, the tissue roll can be inserted directly in the first tissue roll position when the holding mechanism is in the release position, and the tissue roll will be held in that same first tissue roll position by the holding mechanism in the hold position. Shifting the hold mechanism into the release position frees the tissue roll from its support and allows the freefall of the tissue roll, in particular, by gravity only. In particular, it is preferred that the first tissue roll position is a first dispensing position for dispensing tissue from the tissue roll. Further, preferably, the first tissue roll position is a receiving position for receiving a new tissue roll.

According to a preferred embodiment the shift mechanism is adapted for shifting the holding mechanism, in particular, the first and second holding elements, from the hold position to the release position when the diameter sensor detects a reduced tissue roll diameter in the first tissue roll position.

Further, it is preferred that the shift mechanism is adapted for shifting the holding mechanism, in particular, the first and second holding elements, from the release position to the hold position when the diameter sensor detects a full tissue roll diameter in the first tissue roll position.

Preferably, the holding arrangement and its components are adapted to shift the holding mechanism between the hold position and the release position depending on the diameter of a tissue roll in the first tissue roll position detected by the diameter sensor. When a full tissue roll diameter in the first tissue roll position is detected by the diameter sensor, preferably by a movement of the diameter sensor into a position corresponding to a full tissue roll diameter, the shift mechanism shifts the holding mechanism, in particular, the first and second holding elements, from the release position to the hold position to hold the full tissue roll present in the first tissue roll position.

Further, preferably, when the tissue roll in the first tissue roll position is reduced in its diameter due to supply of portions of tissue from the continuous web of tissue coiled on the tissue roll, the diameter sensor detects such a reduced tissue roll diameter, preferably by being in a position corresponding to such a reduced tissue roll diameter. When the diameter sensor detects this reduced tissue roll diameter, the shifting mechanism shifts the holding mechanism, in particular, the first and second holding elements, from the hold position to the release position.

These embodiments also have several advantages. By coupling the activation of the shifting mechanism to the detection of different tissue roll diameters, it is possible to keep a refill tissue roll in the first tissue roll position until a certain reduced diameter of this tissue roll is reached, i.e., until a certain amount of tissue has been dispensed from this tissue roll. For example, it can be preferred that a dispenser in which the holding arrangement is used, has a second tissue roll position, in which a spare tissue roll can be received. Preferably, such a spare tissue roll is a tissue roll with a reduced diameter, i.e., a tissue roll which only has a reduced amount of continuous web of tissue left to be dispensed. In this way, a dispenser can continue to dispense portions of tissue from the remaining amount of continuous web of tissue present on the reduced diameter tissue roll in the second tissue roll position, while the first tissue roll position is empty. Thereby, the time span for dispensing the remaining tissue from the tissue roll in the second tissue roll position can be used by service personnel for providing a new refill tissue roll in the first tissue roll position.

According to a preferred embodiment, the first holding element is horizontally and/or axially spaced from the first end of the axle of the tissue roll in the release position, and the second holding element is horizontally and/or axially spaced from the first end of the axle of the tissue roll in the release position.

Preferably the holding mechanism remains substantially within the same horizontal plane in the hold position and in the release position. Further preferably, the shift mechanism extends in a substantially horizontal plane in the release position and in the hold position.

In particular, it is preferred that the shift mechanism, or at least parts thereof, is arranged such that a movement of the shift mechanism from the hold position to the release position and vice versa is substantially horizontal. Further, it is preferred that the holding mechanism is arranged such that a movement of the holding mechanism, in particular, of the first holding element and the second holding element, from the hold position to the release position and vice versa is substantially horizontal. Preferably, the holding mechanism and/or the shift mechanism and/or at least parts of the shift mechanism, in particular, a toggle mechanism, extend mainly in a substantially horizontal plane during operation of the dispenser and in an operably mounted position of the dispenser. Further preferably, also the main direction of movement of the holding mechanism between the release position and the hold position and of the shift mechanism, at least parts thereof, in particular, the toggle mechanism, is substantially within the same, preferably horizontal, plane.

According to a further preferred embodiment the holding mechanism, in particular, the first holding element and the second holding element, is biased in the release position. In a further preferred embodiment the shift mechanism comprises at least one first biasing element biasing the holding mechanism in the release position.

Further, preferably, the first tissue roll will only move out of the first tissue roll position when the holding mechanism is in the release position.

In a further preferred embodiment, the diameter sensor comprises a locking element for locking the holding mechanism in the hold position and/or for locking the diameter sensor to a housing of a dispenser.

In particular, it can be preferred that the diameter sensor comprises a guide element for activating the shift mechanism, in particular, by unlocking the locking element; wherein preferably the guide element is adapted to engage a guide frame of a dispenser.

Preferably, the shift mechanism comprises a toggle mechanism and/or a transition element. Preferably, the transition element is not part of the toggle mechanism. Further, preferably, the transition element connects the diameter sensor to the shift mechanism, in particular, the toggle mechanism. Further, preferably, the shift mechanism comprises a transition element pivotably connected to the diameter sensor.

While the toggle mechanism preferably extends in a substantially horizontal plane, the transition element preferably protrudes from this horizontal plane. In particular, the transition element can be a substantially flat or curved plate-like element. Further preferably, the transition element is adapted to be mounted on a housing of a dispenser, in particular, on a housing base. For example, the transition element can have at least one upper mounting arm pivotably mounted on the housing and/or a plate-like, possibly curved, element protruding downwards from the at least one mounting arm.

Further, preferably, the diameter sensor is connected pivotably to the transition element. Further, preferably, the diameter sensor and the transition element are connected to each other such that an angle between the two elements changes with the changing diameter of a tissue roll in the first tissue roll position. Preferably, the diameter sensor has a flat or curved plate-like form or shape, respectively. Alternatively, the diameter sensor can be in the form of a rod. Further, preferably, the diameter sensor and/or the transition element change their relative position to each other with a changing diameter of the tissue roll in the first tissue roll position; wherein preferably an angle between the diameter sensor and the transition element is larger in the release position of the holding mechanism and/or in the free position of the transition element than in the hold position of the holding mechanism and/or in the locked position of the transition element.

Preferably, the holding mechanism can only be shifted from the hold position to the release position when the locking element of the diameter sensor is unlocked. Preferably, the locking element of the diameter sensor is adapted such that the locking element is locked, in particular, locks the diameter sensor to the housing of the dispenser when a full tissue roll is present in the first tissue roll position.

The unlocking of the locking element is preferably realized by a guide element of the diameter sensor, which is adapted to unlock the locking element. Preferably, the guide element of the diameter sensor is adapted to engage the guide frame of a dispenser, in particular, a guide frame on a housing base of the dispenser. Preferably, the engagement of the guide element and the guide frame is such that the guide frame provides a contoured guide surface and the guide element comes into sliding contact with this contoured guide surface when the diameter of the tissue roll in the first tissue roll position gradually decreases.

Further, preferably, the guide frame, in particular, the contoured guide surface, is adapted to be adjusted by an adjustment element. It is further preferred that the diameter sensor, in particular, the guide element and/or the locking element, can be adjusted. It is further preferred that the diameter sensor, in particular, the guide element and/or the locking element, can be adjusted in order to adjust its engagement and/or interaction with the guide frame, in particular, in order to adjust the reduced diameter of the tissue roll in the first tissue roll position at which the locking element is unlocked.

Preferably, the guide frame, in particular, the contoured surface of the guide frame, and the guide element are adapted such that the continued sliding contact of the guide element with the contoured surface of the guide frame during reduction of the diameter of the tissue roll in the first tissue roll position gradually moves the position of the diameter sensor such that when a certain, preferably predetermined, reduced diameter of the tissue roll in the first tissue roll position is reached, the locking element of the diameter sensor is unlocked, in particular, moved out of its locked position.

Preferably, as soon as the locking element is unlocked, the shift mechanism shifts the holding mechanism to the release position, preferably by a biasing force exerted by at least one first biasing element.

In a preferred embodiment, the transition element and/or the diameter sensor are arranged substantially midway between the first and second holding elements in an axial direction of the tissue roll. Further, preferably, the holding mechanism and/or the shift mechanism and/or the diameter sensor are substantially symmetric to the plane intersecting the holding arrangement and/or a dispenser orthogonal to a tissue roll axis in the middle of the tissue roll. In particular, it is preferred that the holding mechanism and/or the shift mechanism, in particular, the toggle mechanism, has a substantially U-shaped form, in particular, in a top view.

Individual or all embodiments relating to the holding arrangement can have several advantages. Generally, the diameter sensor is adapted to change its position with a changing diameter of the tissue roll in the first tissue roll position.

Preferably, the diameter sensor is adapted to rest upon an outer periphery of the tissue roll in the first tissue roll position. In a further preferred embodiment the transition element is adapted to, at least partly, rest upon an outer periphery of tissue roll.

In particular, it is preferred that the diameter sensor is adapted to at least partly rest upon a, preferably upper, outer periphery of the tissue roll in the first tissue roll position. It is further preferred that the diameter sensor is biased against the outer periphery of the tissue roll in the first tissue roll position, preferably by a biasing element. For example, the biasing element of the diameter sensor can be an extra weight attached to the diameter sensor in order to bias the diameter sensor in a downward direction like gravity. Alternatively or additionally, a biasing element can be in the form of a spring.

Further preferably, the transition element is adapted to at least partly rest upon a, preferably rear, outer periphery of the tissue roll. Preferably, the transition element can be biased against the outer periphery of the tissue roll, by a biasing element, for example, in the form of extra weight and/or a spring.

According to a preferred embodiment the shift mechanism is in the form of or comprises a toggle mechanism.

In a further preferred embodiment the shift mechanism comprises a first connection arm projecting from the diameter sensor and a first holding arm projecting from the first holding element and a first transition piece pivotably connecting the first holding arm and the first connection arm.

Preferably, the shift mechanism comprises a second connection arm projecting from the diameter sensor and a second holding arm projecting from the second holding element, and a second transition piece pivotably connecting the second holding arm and the second connection arm.

It is particularly preferred that the first transition piece and/or the second transition piece are connected to the support insert via at least one first biasing element, e.g., via at least one spring. The at least one first biasing element preferably serves to bias the holding mechanism in the release position.

Further preferably, the first holding arm is connected to the first transition piece via at least one second biasing element and/or the second holding arm is connected to the second transition piece via at least one second biasing element. This at least one second biasing element preferably exerts a smaller force than the at least one first biasing element and into a different, preferably opposite direction than the at least one first biasing element in order to brake or stop a movement initiated by the at least one first biasing element.

Preferably the first holding element is exchangeable and/or the second holding element is exchangeable. Further, it is preferred that the first holding element is variable and/or the second holding element is variable, in particular, with respect to form and/or shape and/or by adding and/or removing and/or shifting variation elements. Further it is preferred that the first holding element and/or the first holding arm is releasably connected to the shift mechanism and/or the second holding element and/or the second holding arm is releasably connected to the shift mechanism. Further, preferably, the first holding arm is releasably connected to the first transition piece and/or the first connection arm and/or the second holding arm is releasably connected to the second transition piece and/or the second connection arm.

It is particularly preferred that the first holding element comprises a first captive piece for interaction with a part of a tissue roll and/or the second holding element comprises a second captive piece for interaction with a part of a tissue roll. In particular, it is preferred that the first holding element comprises a first identification element for identifying a tissue roll and/or the second holding element comprises a second identification element for identifying a tissue roll. In a further preferred embodiment, the first holding element comprises a first form fit piece for engaging a part of a tissue roll, in particular, its axle and/or an axle cap, in a form fit and/or the second holding element comprises a second form fit piece for engaging a part of a tissue roll, in particular, its axle and/or an axle cap.

The described embodiments for exchanging and/or varying components of the holding mechanism and/or providing captive pieces have the advantage that the holding arrangement is suitable for a variety of tissue rolls and thus a variety of dispensing systems. For example, various kinds of tissue rolls are provided with different kinds of axles. By exchanging and/or varying the holding mechanism, in particular, the holding elements, holding elements suitable for the particular tissue roll can be provided.

In addition, by providing a captive piece on at least one of the holding elements it can be ensured that only specific tissue rolls, for example, with specific characteristics, can be used in and held by the holding arrangement. Such captive pieces can be, for example, in the form of identification elements and/or in the form of form fit pieces. An identification element can be a reader for machine-readable code, such as a barcode or a QR-code, and/or ID-tags, for example, RFID tags, which are present on the tissue roll. A form fit piece, for example, can be any contoured or shaped element suitable for interaction with a correspondingly contoured or shaped element on the tissue roll.

Preferably, a dispensing action is only possible upon correct interaction of a part of the tissue roll, the axle of the tissue roll, with the first and/or second captive pieces.

The corresponding elements on the tissue roll for interaction with the first and/or second captive pieces of the first and/or second holding elements preferably comprise or consist of sustainable and/or recyclable material, such as cardboard and/or wood.

According to a further aspect, it is provided a dispenser for dispensing portions of a continuous web of tissue from a tissue roll comprising a holding arrangement as described herein.

Preferably, the holding arrangement described herein is suitable for use in a dispenser as described herein. In particular, features described with respect to the holding element correspondingly apply to the dispenser and vice versa, if applicable.

It is further preferred that a dispenser comprises a housing with an openable housing cover and a housing base for wall-mounting the dispenser; and/or a dispensing opening; and/or a second tissue roll position for receiving a tissue roll from the first tissue roll position; and/or a cutting unit; and/or a control unit; and/or a user interface; and/or a proximity sensor for detecting the presence of a user; and/or an output mechanism comprising at least two output rollers, preferably a driven roller and a tension roller and/or a transfer mechanism for releasably holding and transferring an end of a tissue roll in the first tissue roll position to the output mechanism; wherein the transfer mechanism is adapted to transfer the end of the tissue roll in the first tissue roll position to the output mechanism when the second tissue roll position is empty.

In particular, the proximity sensor for detecting the presence of the user can be in the form of a hand sensor. Further, preferably a dispensing action is triggered when the proximity sensor detects the presence of the user. In particular, this is preferred for an automatically driven output mechanism. Alternatively, the output mechanism can be manually driven, for example, by a pulling force exerted by the user and/or by providing an output lever or the like for manual handling by a user.

Further, preferably, the holding mechanism and/or the shift mechanism is attached to the housing, in particular, the housing base. It is particularly preferred that the transition element and/or the first and/or second holding arms are attached to the housing base. Preferably, the transition element and/or the first and/or second holding arms are the only elements of the holding mechanism and/or the shift mechanism, which are attached to the housing base.

Further, preferably, the dispenser comprises a support insert, which is mounted preferably on the housing, in particular, on the housing base. Further, preferably, the support insert interacts with the locking element of the diameter sensor and provides a corresponding element for interaction with the locking element of the diameter sensor to keep the locking element locked.

Preferably, the dispenser comprises a first tissue roll position for receiving a tissue roll and a second tissue roll position for receiving a tissue roll; an output mechanism for supplying portions of tissue; a transfer mechanism for releasably holding and transferring an end of a tissue roll in the first tissue roll position to the output mechanism; wherein the transfer mechanism is adapted to transfer the end of the tissue roll in the first tissue roll position to the output mechanism when the second tissue roll position is empty.

The output mechanism preferably supplies portions of tissue from the tissue roll, preferably, to a dispensing opening of the dispenser. Further, preferably, the output mechanism is suitable for supplying portions of tissue from a tissue roll in the first position and/or for supplying portions of a tissue from a tissue roll in the second tissue roll position. The output mechanism can be a manual output mechanism or an automatic output mechanism, in particular, a driven output mechanism, preferably electrically driven, e.g., via a battery supply and/or other energy supply.

A transfer mechanism is preferably provided, which is adapted to releasably hold an end of a tissue roll in the first tissue roll position. Preferably, the first tissue roll position is the receiving position for receiving a refill tissue roll by service personnel. Further, preferably, the second tissue roll position is a position for a further tissue roll. This further or spare tissue roll can be placed in the second tissue roll position by service personnel and/or automatically, in case the full refill tissue roll in the first tissue roll position has become a reduced diameter tissue roll and is, preferably, by gravity, transferred within the dispenser from the first tissue roll position to the second tissue roll position.

The transfer mechanism is further preferably adapted to transfer the end of the tissue roll in the first tissue roll position to the output mechanism. In particular, this is to be understood that the transfer mechanism actually handles the insertion of the end of a tissue roll in the first tissue roll position to the output mechanism, which means that this action does not need to be performed by service personnel. Upon inserting a refill tissue roll into the first tissue roll position, the service personnel preferably only have to insert the end of the tissue roll into the transfer mechanism.

The transfer mechanism is further preferably adapted to transfer the end of the tissue roll in the first tissue roll position to the output mechanism when the second tissue roll position is empty.

An empty tissue roll position is preferably present when no tissue roll is in the second tissue roll position and/or when no tissue is left on a tissue roll in the second tissue roll position, for example, when only the axle of an empty tissue roll is present in the second tissue roll position.

A combination comprising an output mechanism and a transfer mechanism as described herein can be referred to as a dispenser module. Preferably, the output mechanism and/or the transfer mechanism and/or the dispenser module can be provided as separate units, which can be mounted and used in a dispenser and/or which can be exchanged. Further preferably, the output mechanism and/or the transfer mechanism and/or the dispenser module are adapted as retro-fit units for fitting into existing dispensers.

Preferably, the transfer mechanism is adapted to release the end of the tissue roll when this end is inserted into the output mechanism and/or gripped by the output mechanism and/or conveyed by the output mechanism in a supplying operation to supply a portion of tissue to a dispensing opening. Preferably, the transfer mechanism is thus adapted to releasably hold the end of a tissue roll and to release the end of a tissue roll once a predetermined force, particularly, a pulling force, is exerted on the end of the tissue roll, preferably by the output mechanism.

It is particularly preferred that the transfer mechanism is adapted to transfer the end of the tissue roll in the first tissue roll position to the output mechanism only when the second tissue roll position is empty.

The dispenser described herein has several advantages.

For example, by providing a transfer mechanism for transferring an end of a tissue roll in the first tissue roll position to the output mechanism the service personnel are relieved from this task. In particular, in case a spare tissue roll is present in the second tissue roll position and a new tissue roll is inserted into the first tissue roll position, the service personnel only need to ensure that the end of the tissue roll in the first tissue roll position is put into the transfer mechanism to be releasably held there. Preferably, the actual transfer of the end of the tissue roll to the output mechanism is done by the transfer mechanism automatically, without the need for service personnel.

Further, preferably, by adapting the transfer mechanism to transfer the end of the tissue roll in the first tissue roll position to the output mechanism when the second tissue roll position is empty, a particularly efficient solution is provided. In a number of existing solutions, the end of a refill tissue roll is transferred to the output mechanism while there is still tissue on the spare tissue roll in the second tissue roll position. Thus, until the second tissue roll position is empty, tissue from both the refill tissue roll in the first tissue roll position and tissue from the spare tissue roll in the second tissue roll position is supplied. This way, at least for a certain period of time, twice the amount of tissue is supplied and used.

The solution described herein, however, preferably ensures that the end of a tissue roll in the first tissue roll position is transferred to the output mechanism when the second tissue roll position is empty, i.e., a supply of tissue from both a refill tissue roll in the first tissue roll position and a spare tissue roll in the second tissue roll position at the same time is avoided. Thus resource usage is more efficient.

By preferably providing the output mechanism and/or the transfer mechanism and/or the dispenser module as separate, preferably exchangeable and/or retrofit, units, a cost efficient solution is provided. Further, variability with low complexity can be achieved in the dispenser design.

In a further preferred embodiment, the transfer mechanism is adapted to transfer the end of the tissue roll in the first tissue roll position to the output mechanism independently of the direction of unrolling of the tissue roll in the first tissue roll position.

A direction of unrolling the tissue roll in the first tissue roll position can be clockwise or counterclockwise, from an axis of rotation of the tissue roll. During servicing of a dispenser, in particular, during refilling a tissue roll and/or inserting the tissue roll into the first tissue roll position, it is advantageous that the service personnel do not need to pay specific attention to the direction of unrolling of the tissue roll after insertion. Rather, the tissue roll can be inserted in any of the two directions of unrolling, since the transfer mechanism is adapted to releasably hold and transfer the end of the tissue roll in the first tissue roll position to the output mechanism independently of the direction of unrolling.

It is particularly preferred that a dispenser comprises a detector for detecting whether the second tissue roll position is empty. Preferably, whether the second tissue roll position is empty or not is detected before the transfer mechanism transfers the end of a tissue roll in the first tissue roll position to the output mechanism. For example, this detection can be carried out by a control unit. Further, a detector for detecting whether the second tissue roll position is empty or not can be provided. Preferably, the detector is an optical detector.

Preferably, a control unit is provided which is adapted to activate the transfer mechanism to initiate the movement from the service position to the handover position once the detector or tissue sensor has signaled that the second tissue roll position is empty. Further, preferably, the control unit is adapted to initiate the movement of the transfer mechanism from the service position to the handover position in the first dispensing action following the detection of an empty second tissue roll position. In particular, a dispensing action can be understood to be the supply of a portion of tissue to a user, either manually or automatically, and can comprise a respective request from a user, e.g., by pulling a handle or bringing a hand into the proximity of a proximity sensor.

According to a further preferred embodiment a dispenser comprises a tissue sensor for detecting the presence of a tissue connection from a tissue roll in the second tissue roll position to the output mechanism.

Preferably, a tissue sensor is provided, which can detect whether a tissue connection exists between a tissue roll in the second tissue roll position to the output mechanism. Preferably, the tissue sensor is an optical sensor. Preferably, the optical sensor is provided with an infrared glass and/or with a UV filter. Further, preferably, the optical sensor is adapted for a predetermined detection range, in particular, a detection range which corresponds to the distance between the tissue sensor and the tissue connection to be detected.

Detecting the presence of a tissue connection between a tissue roll in the second tissue roll position and the output mechanism has the advantage that the second tissue roll position is detected as empty as soon as a continuous web of tissue is no longer provided from the second tissue roll position to the output mechanism. For example, on the empty tissue roll axle some residue of tissue may remain, which is affixed to the axle and cannot be released from it. Further, it may happen that the tissue connection between a tissue roll in the second tissue roll position in the output mechanism is torn or otherwise interrupted. This condition, too, would be detected as an empty condition of the second tissue roll position. An empty second tissue roll position can be interpreted as a condition, where supply from portions of tissue to the output mechanism from the second tissue roll position is not possible. In these cases, the transfer mechanism is adapted to transfer the end of the tissue roll in the first tissue roll position to the output mechanism. In this way, a continuous dispense of portions of tissue can be ensured, even if the second tissue roll position is empty, for whatever reason.

It is further preferred that the transfer mechanism is adapted to transfer the end of the tissue roll in the first tissue roll position to the output mechanism when the tissue sensor indicates that there is no tissue connection from a tissue roll in the second tissue roll position to the output mechanism.

In particular, it is preferred that the transfer mechanism is adapted to transfer the end of the tissue roll in the first tissue roll position to the output mechanism only when the tissue sensor indicates that there is no tissue connection from a tissue roll in the second tissue roll position to the output mechanism.

Preferably, the transfer mechanism comprises a transfer plate and at least one retainer flap to bias an end of a tissue roll against the transfer plate and releasably hold the end of the tissue roll between the transfer plate and the at least one retainer flap.

Preferably, two, three, or more retainer flaps can be provided. Preferably, the retainer flaps bias the end of the tissue roll against the transfer plate in order to releasably hold the end of the tissue roll such that the end of the tissue roll can be released once it is inserted into the output mechanism, in particular, gripped by the output mechanism to supply portions of the tissue from the first tissue roll position to the dispensing opening.

The provision of a transfer plate and at least one retainer flap to bias the end of the tissue roll has the advantage of providing a very easy solution for inserting the end of the tissue roll in the first tissue roll position between the retainer flap and the transfer mechanism to the service personnel.

Further, it is preferred that the transfer mechanism comprises a transfer rod, wherein the transfer rod is moveable from a service position for receiving the end of the tissue roll to a hand-over position for transferring the end of the tissue roll to the output mechanism.

Preferably, an axis of the transfer rod is substantially parallel to the axis of the tissue roll and/or the axis of an output roller of the output mechanism. Further, preferably, the transfer mechanism is movable from a service position for receiving the end of the tissue roll to a handover position for transferring the end of the tissue roll to the output mechanism.

In particular, it can be preferred that the transfer plate is connected pivotably to the transfer rod and/or pivotably projecting from the transfer rod.

Preferably, the transfer plate is arranged in the middle of the transfer rod in an axial direction of the transfer rod. Further, preferably, the transfer plate projects from the transfer rod in direction toward a person when the housing is open. In this way the action of positioning the end of the tissue roll between the retainer flap and the transfer plate is facilitated.

It is particularly preferred that the output mechanism comprises at least two output rollers, preferably, a driven roller and a tension roller, with an output gap between the output rollers. Preferably, at least one of the two output rollers has at least one recess, preferably, in the form of a reduced diameter. It is particularly preferred that the transfer mechanism, preferably the at least one retainer flap, comprises at least one transfer projection for projecting into the at least one recess of the at least one of the two output rollers in the hand-over position.

Portions of a continuous web of tissue can be supplied by an output mechanism through an output gap between at least two output rollers in an advantageous way. By providing at least one of the two output rollers with at least one recess, preferably, in the form of a reduced diameter, it is possible to have a transfer projection projecting into this at least one recess. Preferably, along an axial extension of the output roller, two, three, or more recesses are formed. Further, preferably, two, three, or more retainer flaps comprising at least one transfer projection for projecting into the respective recesses at the output roller are provided. This projection of the transfer projection into the recess in the handover position facilitates the transfer of the end of the tissue and to release the tissue from the transfer mechanism and to reliably insert the tissue into the gap between the two output rollers.

Preferably, the output gap between the output rollers is adjustable. Further, preferably, the output gap between the output rollers is biased, preferably, via a biasing element such as a spring, in a position where the output roller contact each other. In particular, is it preferred that the output gap and/or the output rollers is/are adapted to accommodate kinds of tissue with different thickness and/or one, two, or several layers of tissue. In particular, it is preferred that one of the output rollers is in a fixed position and the other output roller is in a moveable position, and preferably biased toward the fixed output roller.

Further, it is preferred that the transfer mechanism is adapted to repeat a movement from the service position to the handover position and back at least once, preferably, twice or three times.

A repetition of the movement from the service position to the handover position and back has the advantage that in case the transfer has not been successful during the first movement from the service position to the handover position, or has not been fully successful, the repetition of this movement significantly enhances reliability of the transfer action. At the same time, in case the first movement from the service position to the handover position has been successful, a repetition of this movement does not have any further effect and does not interfere with a successful previous transfer, i.e., an already successfully established tissue connection between the tissue roll in the first tissue roll position and the output mechanism is not negatively influenced by this repetition of the movement. This movement of the transfer mechanism from the service position to the handover position can also be described as a transfer action. By moving the transfer mechanism back to the service position after the movement into the handover position, the transfer mechanism is ready for receiving the end of a new refill tissue roll from service personnel and/or is ready for a repeated movement from the service position to the handover position.

Preferably, the transfer mechanism is adapted to repeat the movement from the service position to the handover position and back within a predetermined period of time, preferably, after an initial activation of the transfer mechanism and/or after a first transfer action, i.e., after a first movement from the service position to the handover position and back. Further, it can be preferred that the transfer mechanism is adapted to repeat the movement from the service position to the handover position and back until a tissue connection between a tissue roll in the first tissue roll position and the output mechanism is established. Preferably, a further detector and/or a further tissue sensor for detecting the presence of a tissue connection between a tissue roll in the first tissue roll position and the output mechanism is provided.

In general, it is preferred that a control unit is present, which preferably is connected to various components of the dispenser using a wired or wireless connection in order to transfer signals, e.g., sensor signals, activation signals, control signals and the like, and to generate and/or process and/or receive and/or transmit such signals. Further, preferably, the control unit may, using either a wireless or wired connection, also be connected to external components, for example a washroom information system.

In particular, it is preferred that the control unit is adapted to change an operation mode of the dispenser, in particular, of the output mechanism depending on whether the holding mechanism is in the release position or in the hold position and/or depending on whether the output mechanism supplies portions of tissue from a tissue roll in the first tissue roll position or in the second tissue roll position. Preferably, the operation mode of the dispenser is changed from a normal mode to a tissue saving mode when the holding mechanism is in the release position and/or when the output mechanism supplies portions of tissue from a tissue roll in the second tissue roll position. Further, preferably, the operation mode of the dispenser is changed back from the tissue saving mode to the normal mode when the holding mechanism is in the hold position and/or when the output mechanism supplies portions of tissue from a tissue roll in the first tissue roll position. Preferably, a tissue portion in the tissue saving mode is shorter than a tissue portion in the normal mode. Further, preferably, the control unit is adapted to operate the output mechanism for a shorter period of time per dispensing action in the tissue saving mode than in the normal mode. A shorter operation of the output mechanism preferably leads to a shorter tissue portion. In this way, by providing for a tissue saving mode, the remaining tissue on the tissue roll in the second tissue roll position can last longer, in particular, until a new tissue roll is inserted into the first tissue roll position.

In a further preferred embodiment the output mechanism is adapted to operate in reverse in case of a blockage. Further, preferably, the transfer mechanism is adapted to transfer the end of the tissue roll in the first tissue roll position to the output mechanism after an operation of the output mechanism in reverse mode.

The operation of the output mechanism is usually effected in a supply mode, wherein tissue is conveyed toward a dispensing opening in the housing of a dispenser. However, in case some error occurs, for example, in the form of a blockage of a component, such as the output mechanism or the tissue roll, it is preferred that the output mechanism is adapted to operate in reverse mode. Preferably, in the reverse mode the output mechanism operates to convey tissue in an opposite direction as compared to the supply mode, i.e., away from the dispensing opening. In case the output mechanism comprises output rollers, the output rollers operate in rotation directions opposite to their rotation directions during supply mode.

Further, preferably, the output mechanism is adapted to operate in reverse mode for a predetermined period of time. After this predetermined period of time, the output mechanism preferably operates again in supply mode. Should the blockage persist, it is preferred that the output mechanism is adapted to operate in reverse mode again. Preferably, this switching back and forth between supply mode and reverse mode can be repeated, preferably for a predetermined number of times and/or for a predetermined time and/or until the blockage is overcome.

Preferably, the output mechanism and/or a control unit is adapted to detect a blockage. It is particularly preferred that the output mechanism and/or a control unit is adapted to detect a blockage through motor current monitoring of a motor driving a driven output roller.

It is further preferred that the transfer mechanism is adapted to perform a transfer action after the output mechanism has been operated in reverse mode. Usually, once the output mechanism has been operated in reverse mode, there is no tissue connection between a tissue roll in the second tissue roll position and the output mechanism. This is often desired since a blockage may be caused by a damaged or otherwise nonfunctional tissue roll. So, by operating the output mechanism in reverse mode, it is intended to release the tissue connection between the tissue roll in the second tissue roll position and the output mechanism. Subsequently, by performing a transfer action with the transfer mechanism, the end of the refill tissue roll in the first tissue roll position is transferred to the output mechanism and supply of portions of tissue from the refill tissue roll in the first tissue roll position is possible.

Further, preferably, the housing cover comprises a first protrusion adapted to contact a contact flap of the diameter sensor when the housing is closed.

In this embodiment, an interaction of a contact flap of the diameter sensor with a first protrusion on the housing cover is provided when the housing is closed. Preferably, this interaction is such that the locking element of the diameter sensor snaps into its locked position upon closing of the housing. While the locking element is moved into its locked position preferably already upon insertion of a full refill tissue roll into the first tissue roll position, it is preferred that upon closing of the housing cover and the interaction of the first protrusion with the contact flap of the diameter sensor, the locking element is snapped in in the locked position.

This has the advantage that the locking element is prevented from accidentally being unlocked before the tissue roll has reached the predetermined reduced diameter. Such a solution against accidental unlocking has the advantage of providing extra protection against accidental unlocking for example due to vibrations caused by collisions, e.g., with users or equipment.

In particular, it is preferred that a dispenser comprises a level indicator having a filled position and an empty position, wherein the level indicator is adapted such that the level indicator is in its filled position when the holding mechanism is in its hold position and the level indicator is in its empty position when the holding mechanism is in its release position.

Preferably, the housing, in particular, the housing cover, has an indicator opening or a see-through window, through which service personnel can see whether the level indicator is in its filled position or in its empty position. Preferably, the level indicator has an indication surface for indicating the filled and the empty position. Preferably, the level indicator is adapted such that in its filled position a different part of the indication surface is viewable through the see-through indicator opening in the housing than in its empty position.

Coupling the level indicator, preferably, mechanically, to the holding mechanism provides a very easy and reliable solution to indicate to service personnel whether the first tissue roll position is empty, and thus available for a refill, without the need to open the housing, which contributes to efficient servicing.

Further, it is preferred that a dispenser comprises a tissue roll axle receptacle; wherein preferably the tissue roll axle receptacle is openable. It is further preferred that the tissue roll axle receptacle is pivotably connected to the housing base. According to a preferred embodiment, the tissue roll axle receptacle is open when the housing cover is open.

Further, preferably, the tissue roll axle receptacle comprises a retention element retaining the tissue roll axle when the tissue roll axle receptacle is open.

A tissue roll axle receptacle is preferred in order to have a designated place for empty tissue roll axles. An empty tissue roll axle can be in the form of one elongated axle or in the form of two axle stubs, in case a tissue roll axle is not continuous along the axis of a tissue roll but is only present as axle stubs on the two ends of the axle. Preferably, empty tissue roll axles enter the tissue roll axle receptacle after the continuous web of tissue has been used up entirely. In particular, it is preferred that an empty tissue roll axle enters the tissue roll axle receptacle from the second tissue roll position.

The tissue roll axle receptacle is preferably open when the housing cover is open. It is particularly preferred that in the open position of the tissue roll axle receptacle, tissue roll axles or axle stubs contained therein are prevented from falling out by a retention element. At the same time, it is preferred that the open tissue roll axle receptacle provides easy access for service personnel to the tissue roll axles or axle stubs contained therein in order to remove them.

It is particularly preferred that the first tissue roll position and/or the second tissue roll position comprises an axle opening through which the axle of the tissue roll can pass; wherein preferably a stop element is provided for stopping the axle of the tissue roll from passing the axle opening, wherein preferably the stop element is arranged to let the axle of the tissue roll pass through the axle opening when a further tissue roll enters the first tissue roll position and/or the second tissue roll position.

Preferably, axles of tissue rolls (when empty) can pass into the tissue roll axle receptacle from the first tissue roll position and/or the second tissue roll position through an axle opening. Preferably, the axle opening is dimensioned such that only empty axles of tissue rolls or axles of tissue rolls with a very small amount of remaining tissue thereon can pass the axle opening. For example, the axle opening can be in the form of an elongated slot within a trough-like receiving section for the tissue roll in the second tissue roll position.

Further, preferably, a stop element is provided, which preferably reduces the axle opening such that the axle of a tissue roll cannot pass the axle opening only by the force of gravity. Preferably, the stop element is arranged to let the axle of a tissue roll pass upon the exertion of a downward force on the axle of a tissue roll.

In particular, such a downward force is exerted on the axle of a tissue roll in the second tissue roll position, when a tissue roll with a reduced diameter is released from the first tissue roll position and enters the second tissue roll position. This falling tissue roll exerts a downward force on the axle of a tissue roll and thus on the stop element, which is preferably an elastic element. In this way, the stop element can let the axle of a tissue roll pass when a certain downward force is exerted upon the axle of a tissue roll.

According to a further aspect, it is provided a method for holding a tissue roll in a dispenser for dispensing portions of a continuous web of tissue from a tissue roll, the method comprising holding a tissue roll in a first tissue roll position by engaging a first end of an axle of the tissue roll with a first holding element of a holding mechanism and engaging a second end of the axle of the tissue roll with a second holding element of the holding mechanism; detecting the diameter of a tissue roll in the first tissue roll position with a diameter sensor; shifting the holding mechanism, in particular, the first and second holding elements, from a hold position to a release position and vice versa; wherein a distance between the first holding element and the second holding element in the release position is larger than a distance between the first holding element and the second holding element in the hold position.

As to the advantages, preferred embodiments, and details of these further aspects and their preferred embodiments, reference is made to the corresponding advantages, preferred embodiments and details described above.

BRIEF DESCRIPTION OF THE DRAWINGS

Preferred embodiments shall now be described with reference to the attached drawings, in which.

DETAILED DESCRIPTION OF THE EMBODIMENTS

Figure 1:
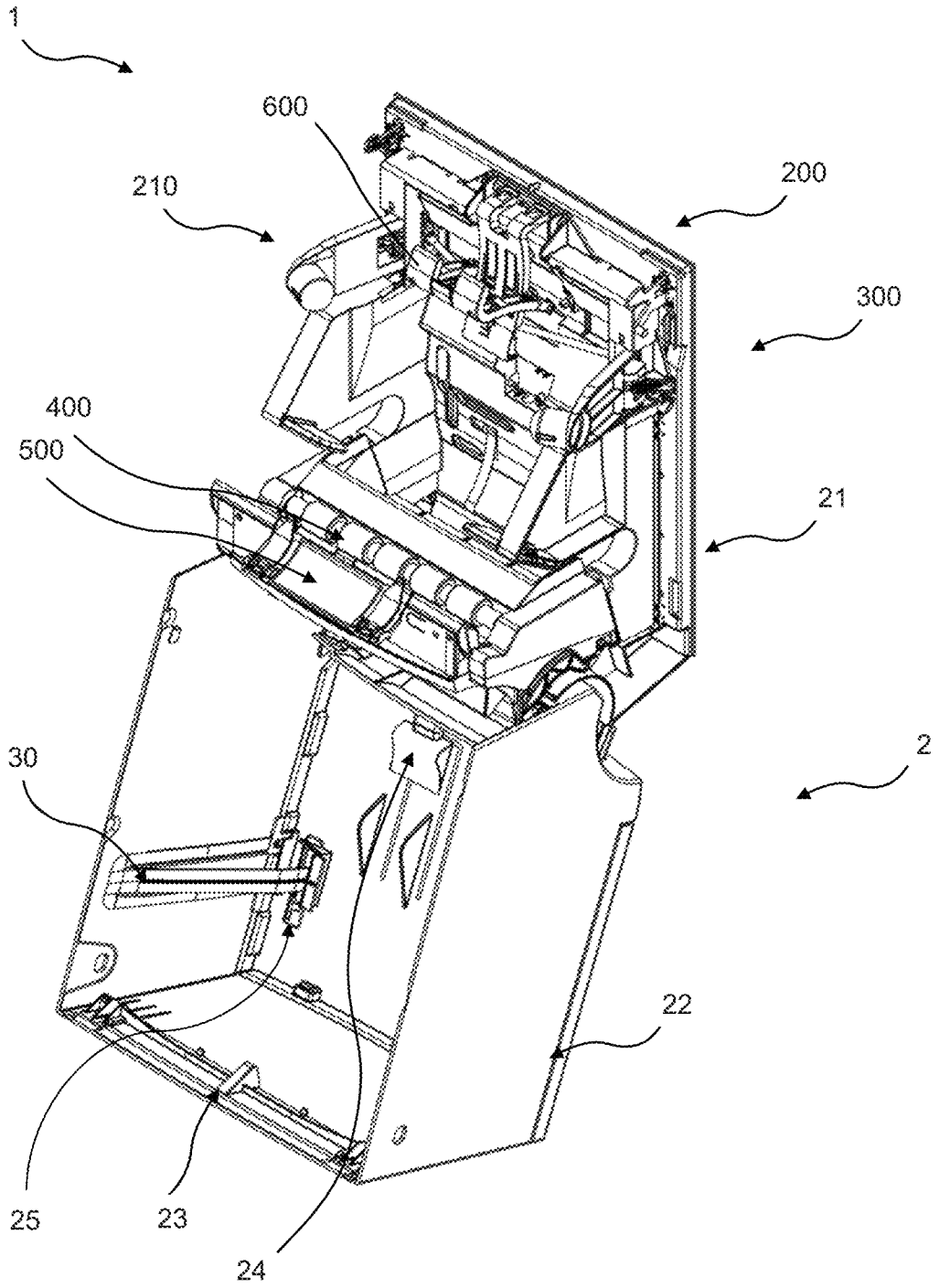
FIG. 1 is a three-dimensional front view of an exemplary embodiment of a dispenser with an open housing cover and with a holding arrangement in the release position.
Figure 2:
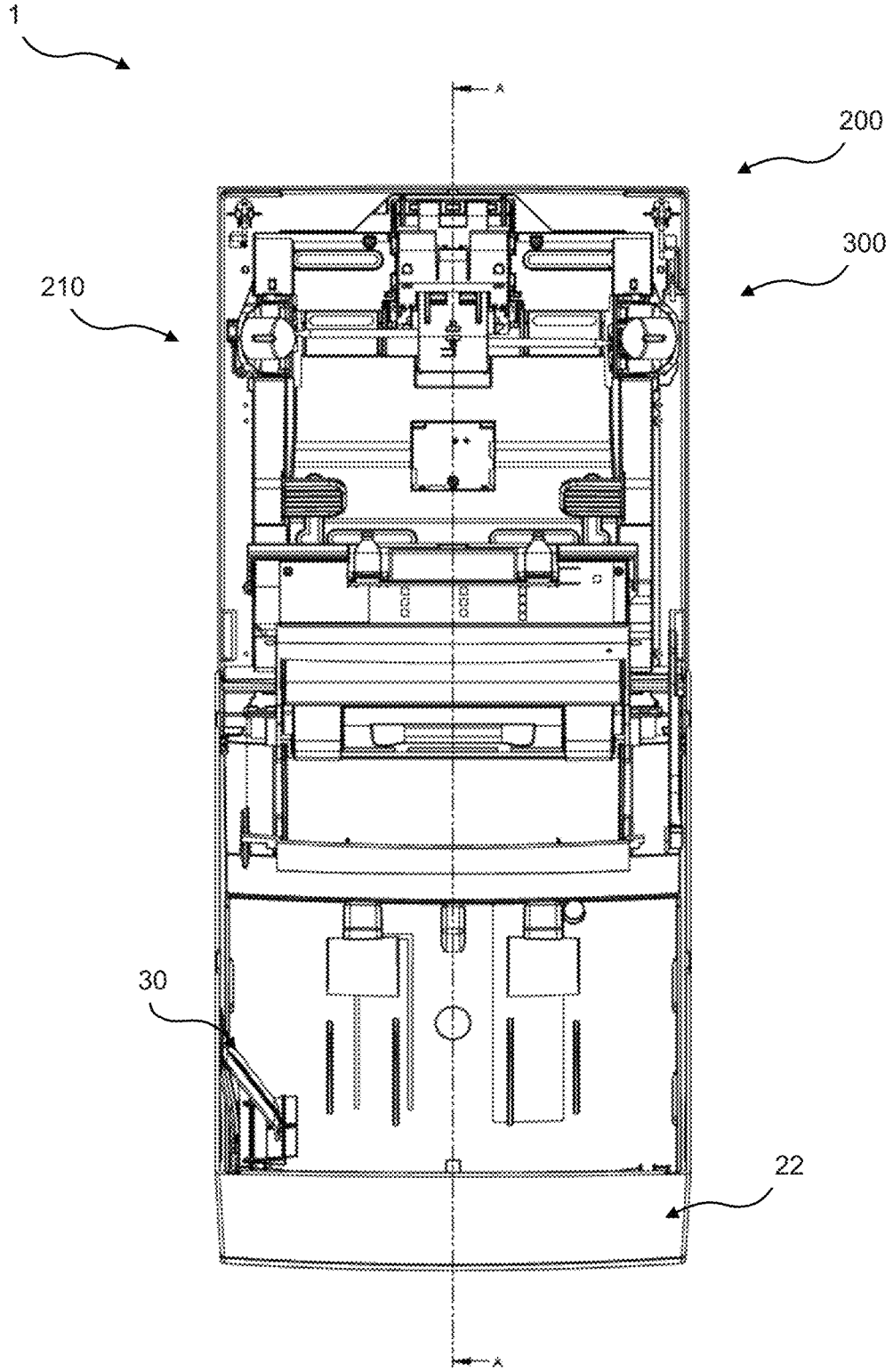
FIG. 2 is a front view of the dispenser according to FIG. 1.

In the Figures, elements with the same or comparable functions are indicated with the same reference numerals.

In the F, a dispenser 1 is shown with a housing 2 comprising a housing base 21 for wall mounting the dispenser 1 and an openable housing cover 22. The housing cover 22 is connected pivotably to the housing base 21. FIGS. 1 to 6 show the housing cover 22 in its open position.

As can be seen in FIG. 1, for example, on the inner upper side of the housing cover 22 a first protrusion 23 is provided and on the lower inner side of the housing cover 22 a second protrusion 24 is provided. The function of these two protrusions 23, 24 will be explained in detail below. Further, on the inside of one of the sidewalls of the housing cover 22 a level indicator 30 is provided. The level indicator 30 will also be described in further detail below. Further, on the front side of the housing cover 22 an indicator opening 25 is provided, through which an indication surface 33 of a level indicator 30 can be seen, as will be described further below. As can be seen from FIG. 21, the indicator opening 25 is covered by a cover glass 26. Optionally, a front panel 27 can be provided on the housing cover 22.

The dispenser 1 further comprises a holding arrangement 200 with a holding mechanism 210, a shift mechanism 300, and an output mechanism 400, a transfer mechanism 500, and a diameter sensor 600, which will be discussed in more detail below.

Figure 21:
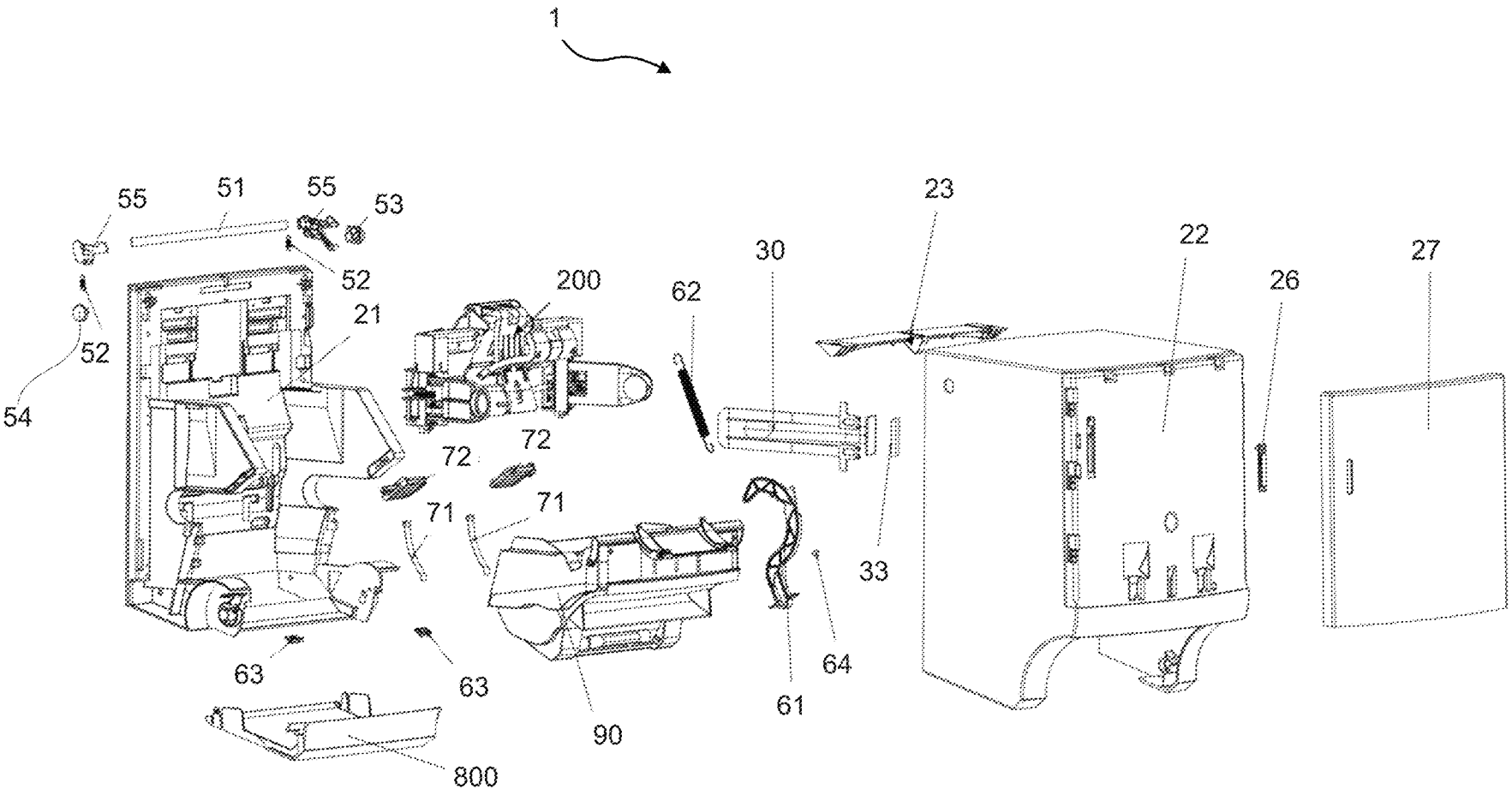
FIG. 21 is an exploded view of an embodiment of a dispenser.

As can be seen from FIG. 21, the housing cover 22 is pivotably mounted to the housing base 21 via a bracket 61, housing spring 62, and cover magnet 64, and secured against unintentional release via safety catches 63. The housing cover 22 can be locked to the housing base 21 via a closure mechanism (see FIG. 21), which can be operated via a key by service personnel. The closure mechanism comprises a flat steel 51, lock springs 52, lock catches 55, a lock lever 53, and a lock plug 54.

Figure 18:
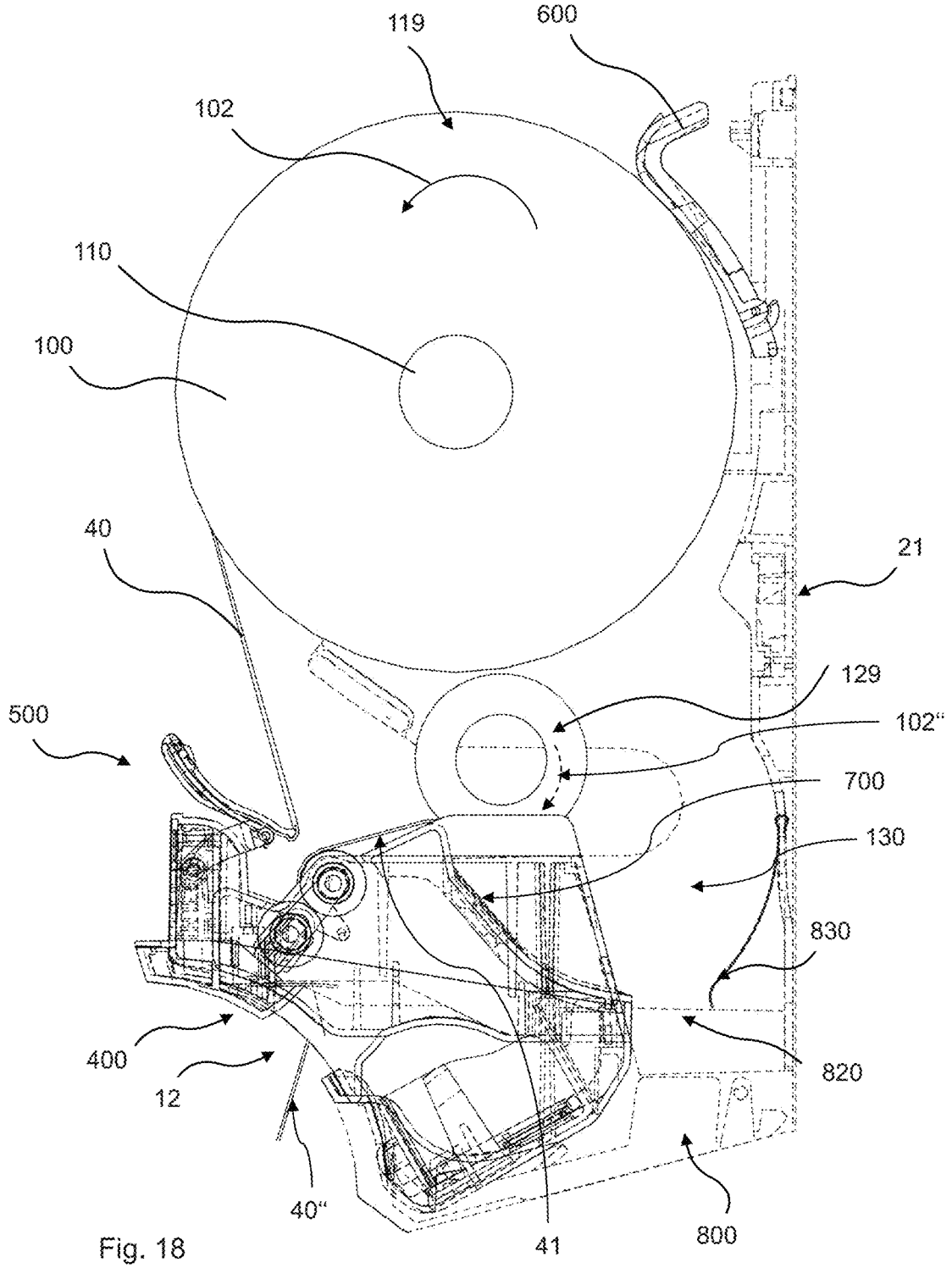
FIG. 18 is a partial section of the dispenser according to FIG. 1 with a full tissue roll and a reduced diameter tissue roll.

As can be seen in FIG. 18, for example, the dispenser 1 has a first tissue roll position 119 with a refill tissue roll with a continuous web of tissue 40 and a second tissue roll position 129 with a spare tissue roll with a further continuous web of tissue 40". The tissue roll 100 in FIG. 18 has a counterclockwise direction of unrolling 102 and the tissue roll in the second tissue roll position 129 has a clockwise direction of unrolling 102".

Figure 3:
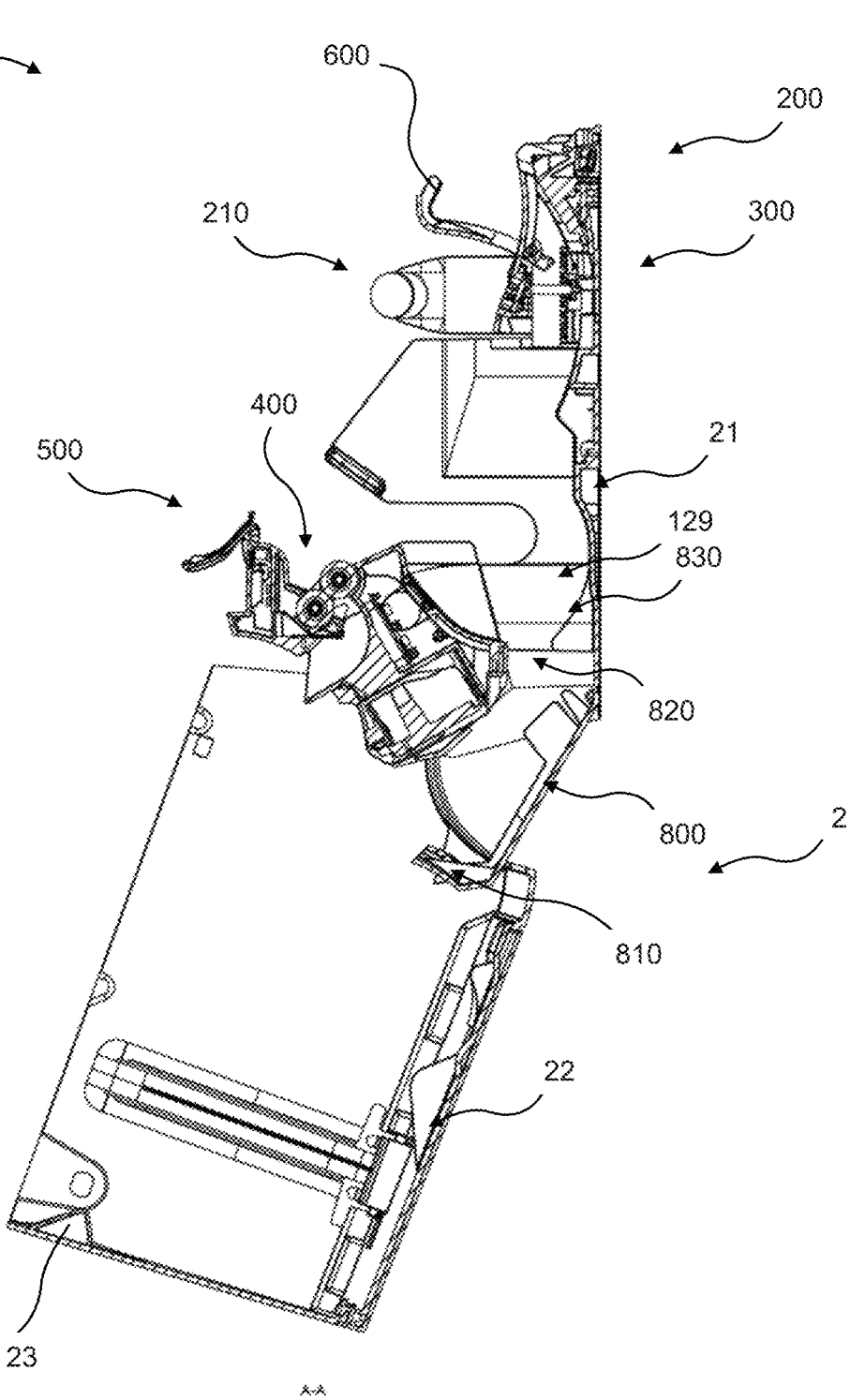
FIG. 3 is a section along A-A as indicated in FIG. 2.
Figure 4:
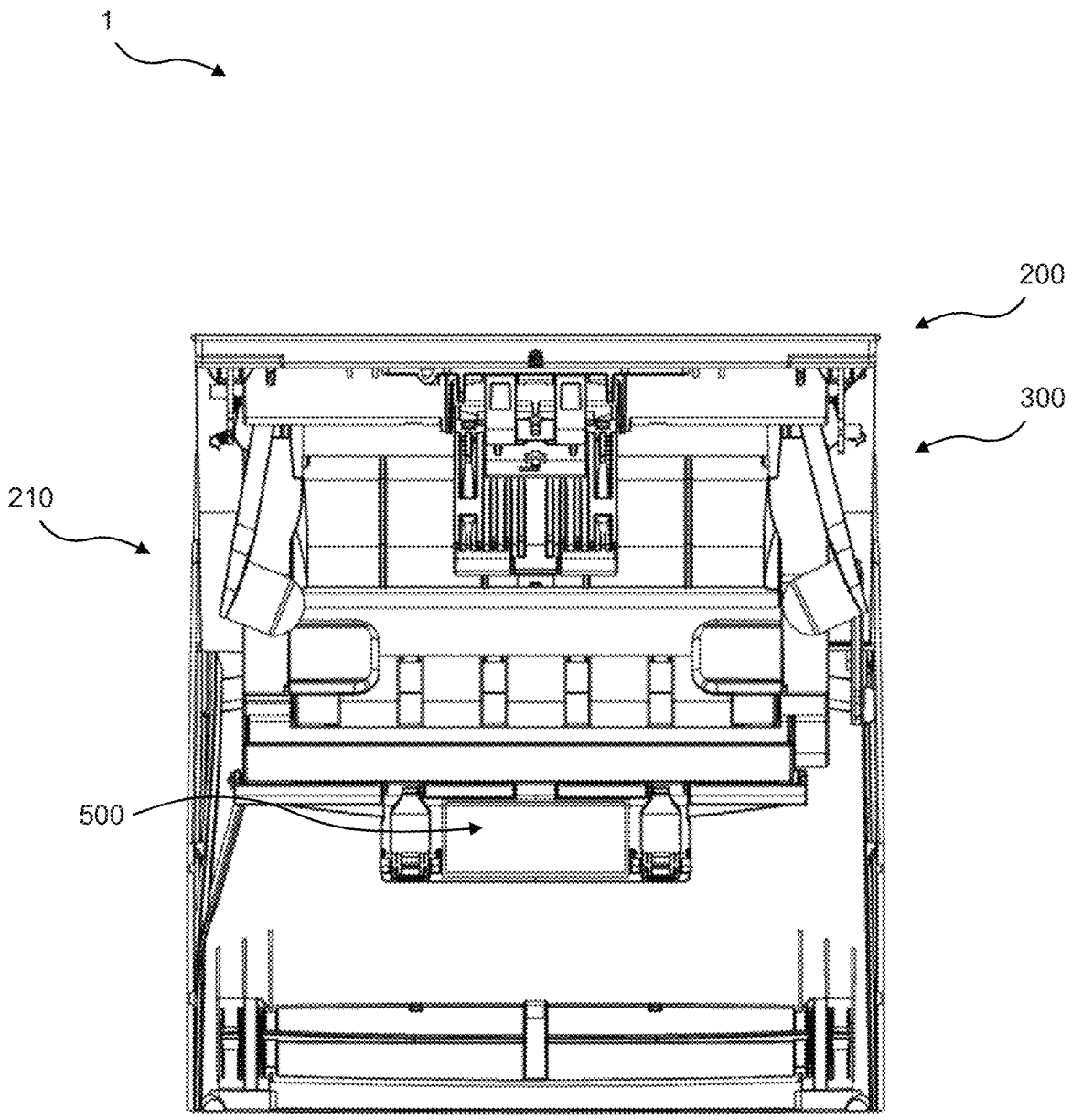
FIG. 4 is a top view of the dispenser according to FIG. 1.
Figure 5:
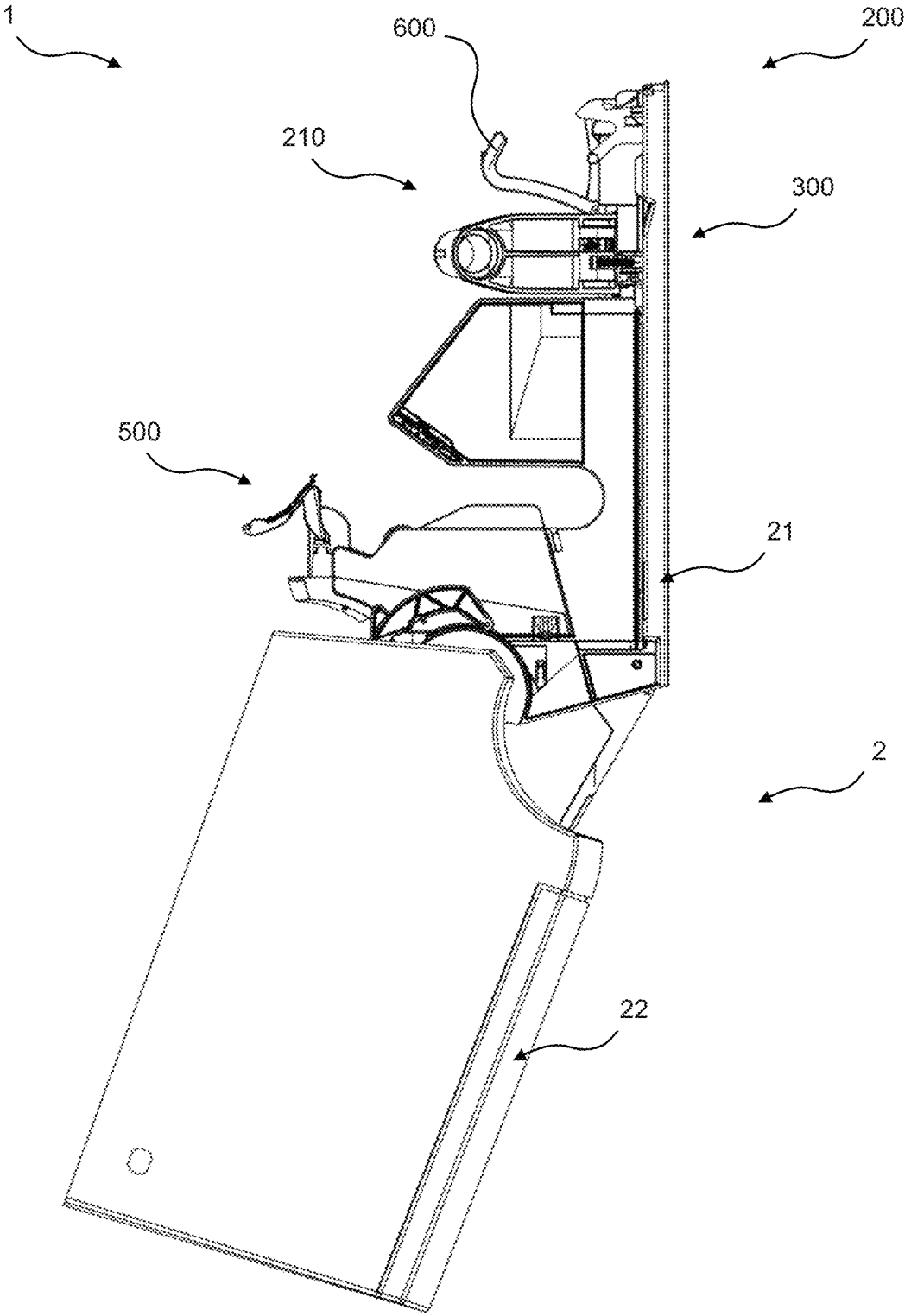
FIG. 5 is a side view of the dispenser according to FIG. 1.
Figure 6:
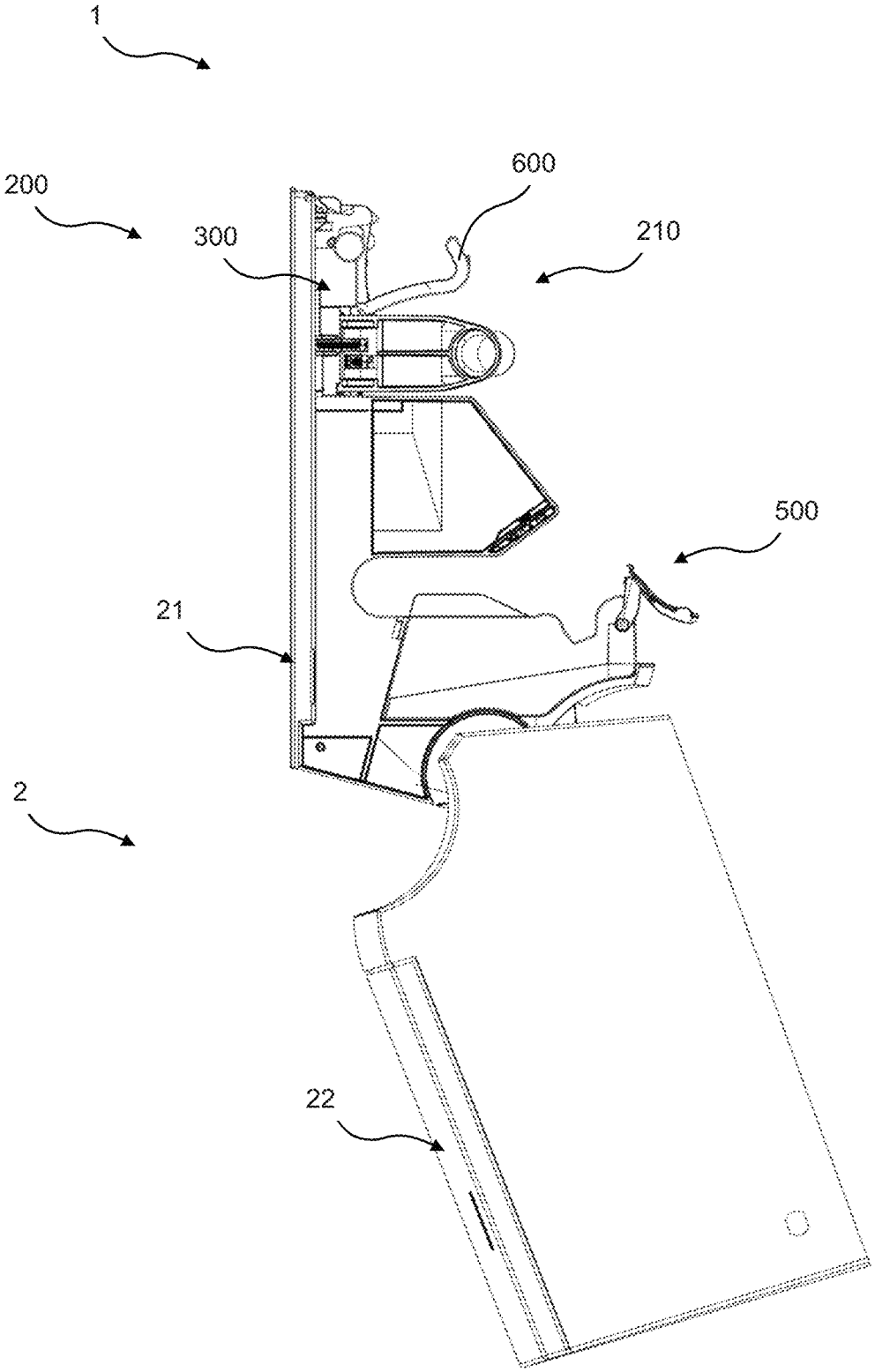
FIG. 6 is a further side view of the dispenser according to FIG. 1.
Figure 20:
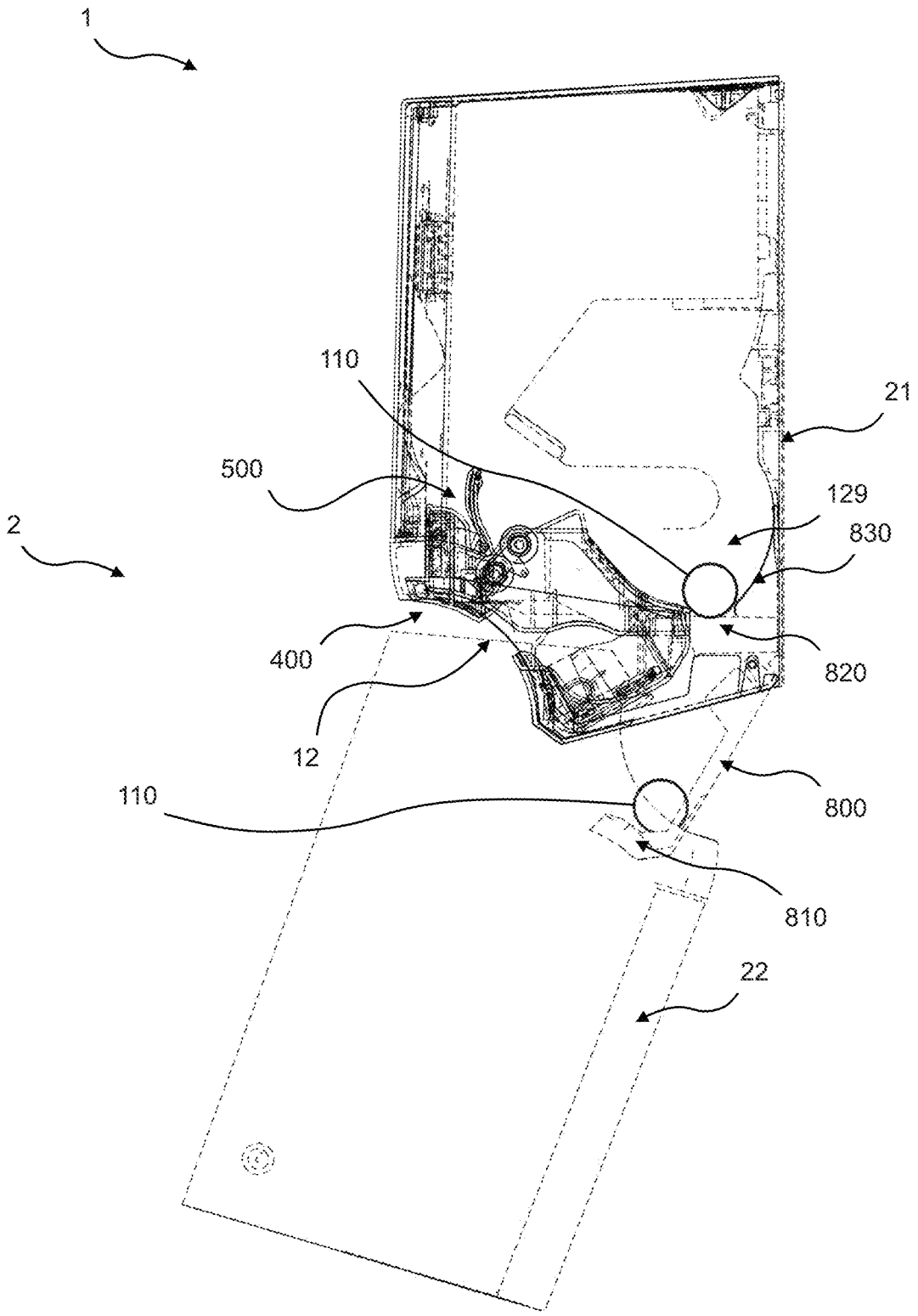
FIG. 20 is a partial section of the dispenser according to FIG. 1 with the housing in the closed and in the open position and an empty tissue roll in different positions.

At the lower end of the second tissue roll position 129, an axle opening 820 is provided through which an empty axle of the tissue roll can pass to enter a tissue roll axle receptacle 800, as can be seen in FIGS. 3 and 20. The axle opening 820 has a stop element 830, which is an elastic element. The stop element 830 stops the empty axle of the tissue roll from passing the axle opening 820 only by the force of gravity. Rather, when a tissue roll is being released from the first tissue roll position 119 and falls down to the second tissue roll position 129, a downward directed force is exerted on to the empty axle 110 of the tissue roll, which then can temporarily move the stop element 830 and pass the axle opening 820 to enter the tissue roll axle receptacle 800. The tissue roll axle receptacle 800 has a retention element 810 retaining the axle 110 of the tissue roll when the tissue roll axle receptacle 800 is open, as can be seen in FIG. 20. Preferably, the tissue roll axle receptacle 800 is in its open position (shown in broken lines in FIG. 20), when the housing cover 22 is in its open position (shown in FIG. 20, also in broken lines).

Figure 7:
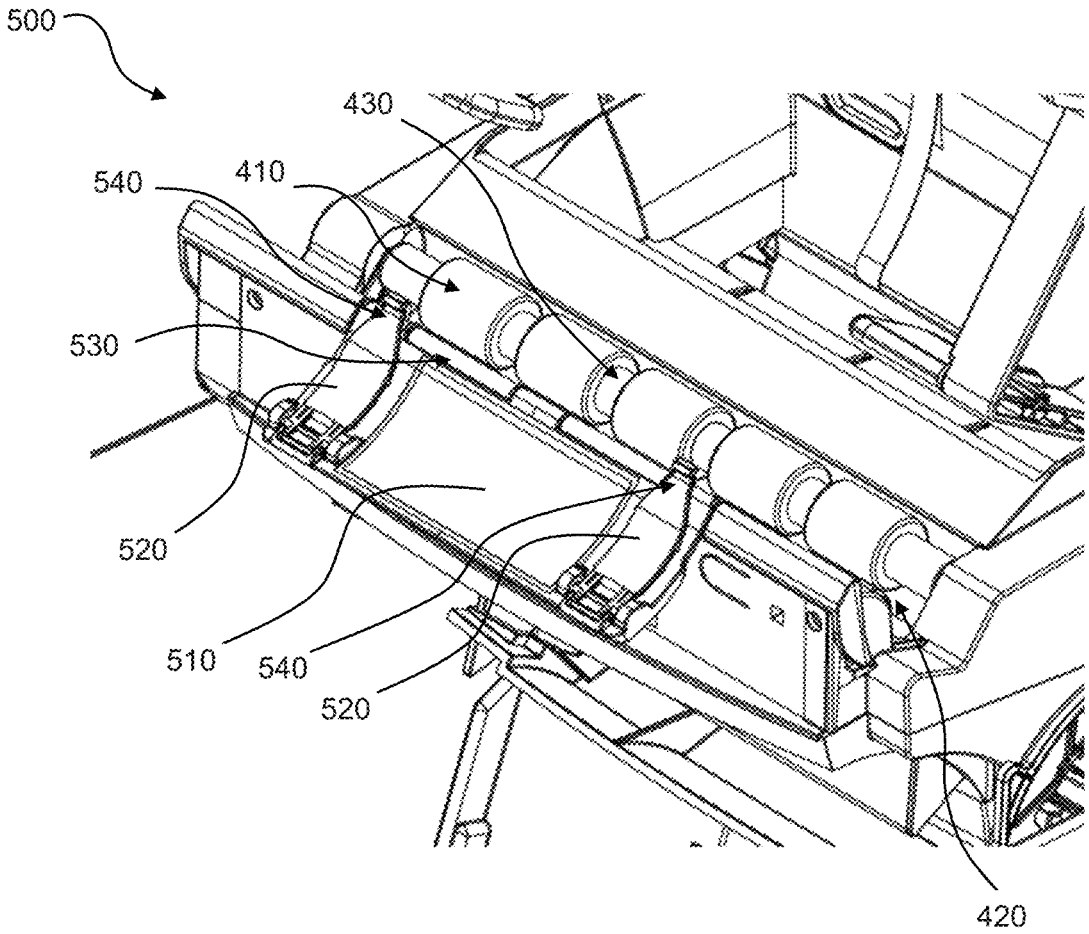
FIG. 7 is an enlarged detail of the dispenser according to FIG. 1.
Figure 8:
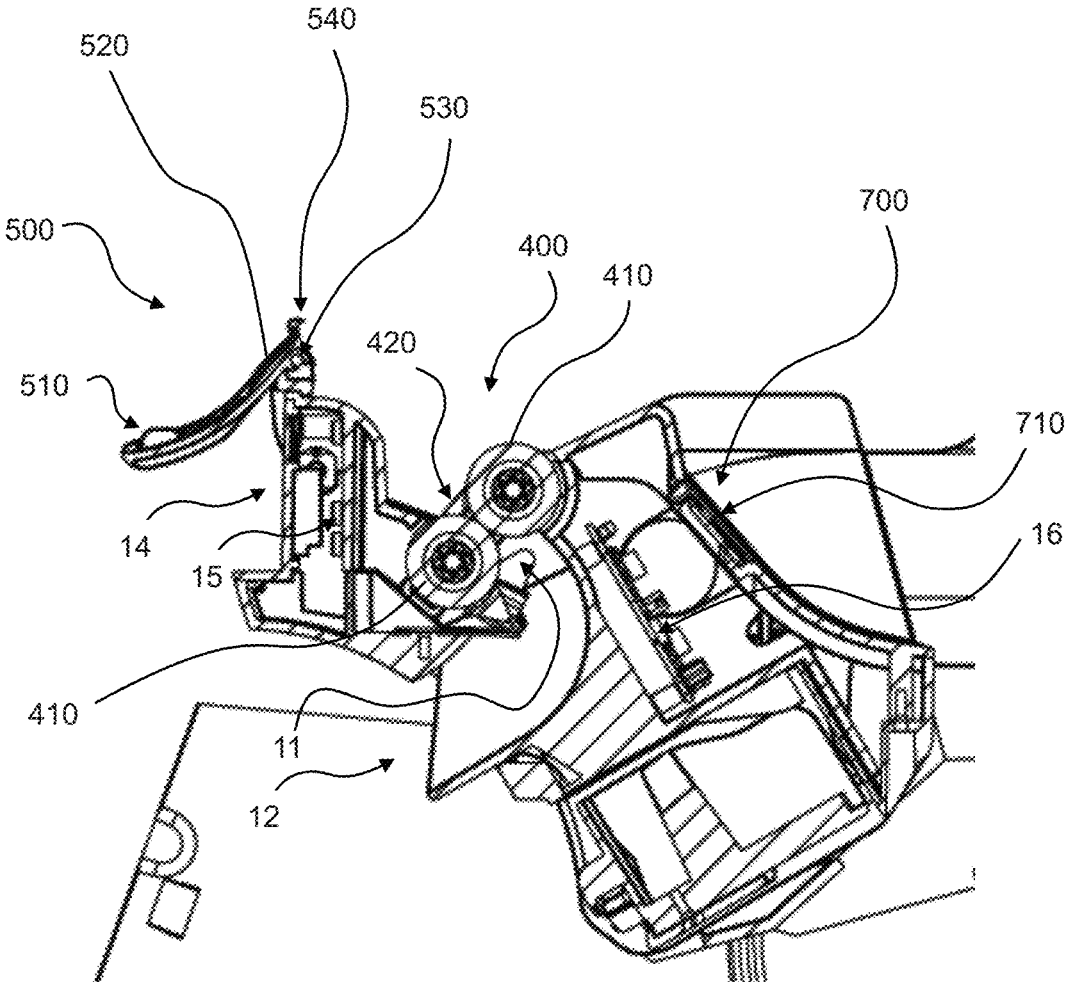
FIG. 8 is an enlarged detail of the dispenser according to FIG. 3.
Figure 19:
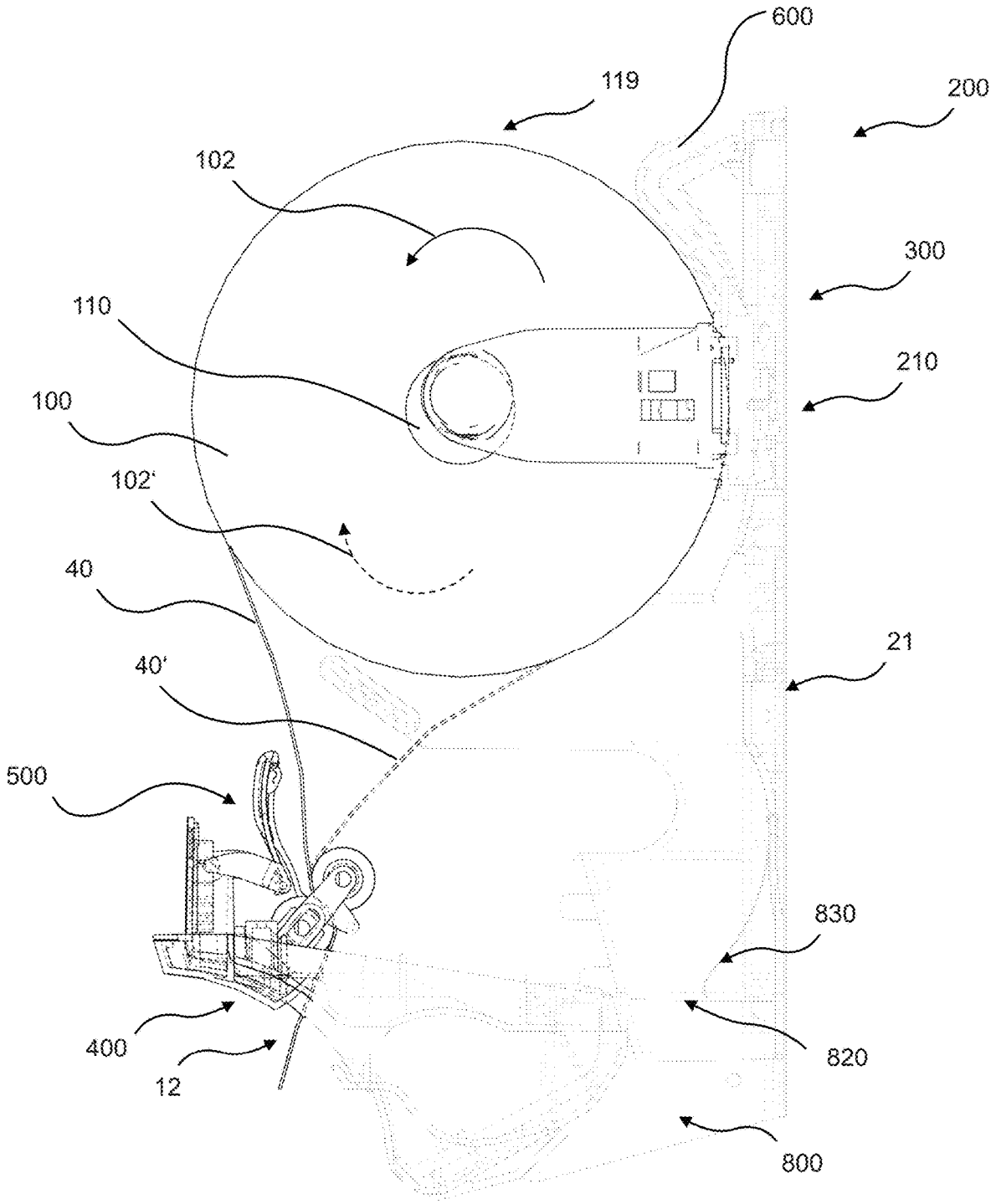
FIG. 19 is a partial section of the dispenser according to FIG. 1 with a full tissue roll and two different directions of unrolling the tissue roll.
Figure 23:
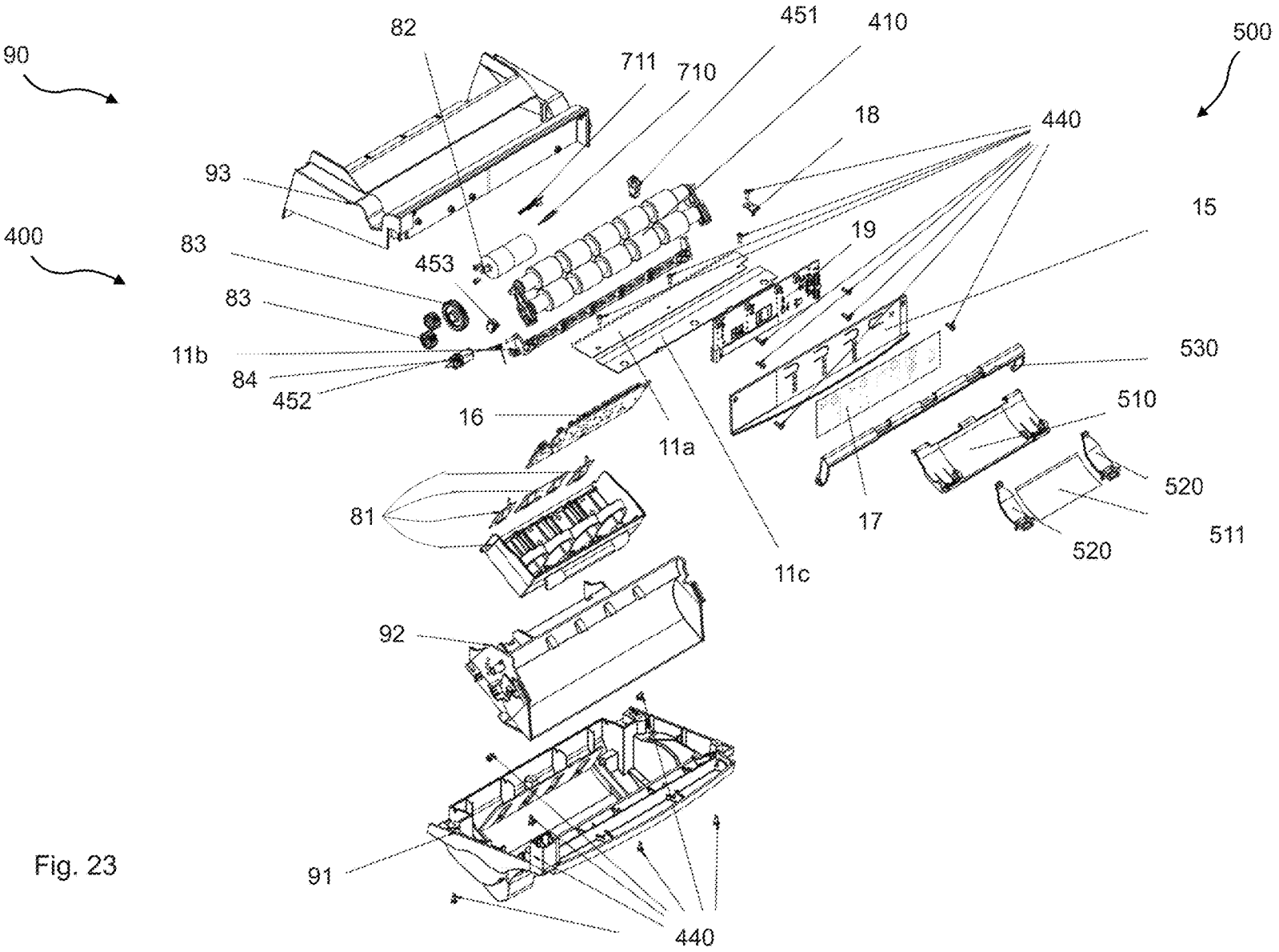
FIG. 23 is an exploded view of an embodiment of a dispenser module.

In FIGS. 7 and 8, as well as in FIGS. 18, 19, and 23, a dispenser module 90 and the output mechanism 400 and the transfer mechanism 500 are shown in more detail. The dispenser module 90 preferably comprises a module body 91, a module center 92, and a module cover 93. The elements of a dispenser module 90 can be connected by screws 440, for example.

As can be seen in FIG. 8, for example, the output mechanism 400 for supplying portions of tissue from a tissue roll in the first or second tissue roll position to a dispensing opening 12 comprises two output rollers 410. A continuous web of tissue can be supplied to the dispensing opening 12 by a rotation of the output rollers 410 through an output gap 420 between the output rollers 410. The output mechanism 400 is suitable for supplying portions of tissue from a continuous web tissue regardless of whether the tissue roll is in the first tissue roll position 119 or in the second tissue roll position 129 (see FIG. 18). As depicted in FIG. 23, the output mechanism 400 and/or the transfer mechanism 500 and/or the dispenser module 90 can comprise a battery module 81, a drive unit 82 with a gear transmission 83, and a holder 84 for driving the output rollers 410.

In FIG. 18, a tissue roll with a reduced diameter is present in the second tissue roll position 129, and tissue 40" is supplied by the output mechanism 400 to the dispensing opening 12. As can be seen, for example, in FIG. 18, a tissue roll can be held in the second tissue roll position 129 by a trough-like receiving section 130 in a lower portion of the dispenser 1. When the spare tissue roll with a very reduced diameter as shown in FIG. 18 has a tissue 40" connection to the output mechanism 400, the tissue roll can be at an upper portion of the trough-like receiving section 130 in the second tissue roll position 129. In case the spare tissue roll still has a slightly larger diameter than shown in FIG. 18, this spare tissue roll is heavier and can thus be positioned in a lower portion of the trough-like receiving section 113 for the second tissue roll position. When the spare tissue roll is completely empty and only the axle remains, the axle 110 usually by gravity moves to the lower part of the trough-like receiving section 130, where the tissue roll axle opening 820 is located, as can be seen from FIG. 20.

As can be seen in FIG. 18, the transfer mechanism 500 holds an end of a tissue roll 100 in the first tissue roll position 119. As can be seen in FIG. 19, the transfer mechanism 500 is adapted to hold and transfer an end of a tissue roll in the first tissue roll position 119 independent from its unrolling direction, which can be counterclockwise 102 or clockwise 102' (broken lines). The transfer mechanism 500 is shown in its service position in FIG. 18 and in its handover position in FIG. 19.

Further, FIGS. 7 and 8 also show the transfer mechanism 500 in its service position. The transfer mechanism 500 is adapted for releasably holding and transferring an end of tissue 40, 40' from a tissue roll 100 in the first tissue roll position 119 to the output mechanism 400. The transfer mechanism 500 comprises a transfer plate 510 and two retainer flaps 520. The retainer flaps 520 are mounted on the transfer plate 510. The transfer plate 510 is pivotally connected to a transfer rod 530, which is movable to bring the transfer mechanism 500 from the service position into the handover position. Transfer rod 530 is driven by drive 452. Each of the retainer flaps 520 comprises a transfer projection 540. Between the retainer flaps 520 a middle flap 511 (see FIG. 23) can be provided.

At least one of the rollers 410 of the output mechanism 400 comprises several axially spaced recesses 430 in the form of a reduced diameter of the output roller 410. The transfer projections 540 of the retainer flaps 520 are adapted to project into the recesses 430 of the output roller 410 in order to transfer the end of the tissue into the gap 420 between the output rollers 410 in the handover position, as can be seen, for example, from FIG. 19.

The end of the tissue roll in the first tissue roll position can be inserted into the transfer mechanism 500 by inserting the end of the tissue roll between the retainer flaps 520 and the transfer plate 510. The end of a tissue roll can be biased in between. In the service position, the transfer plate 510 projects from the transfer rod 530 in direction toward a user when the housing is open. This facilitates the insertion of an end of the tissue roll into the transfer mechanism 500, in particular, between the retainer flaps 520 and the transfer plate 510, by a user. When the housing cover is closed, preferably the second projection 24 on the lower inner side of the housing cover 22 contacts the transfer plate 510 and slightly lifts the transfer plate 510 from its service position shown in FIG. 8 into a slightly higher position shown in FIG. 18. From this position shown in FIG. 18, the transfer mechanism 500 can move into the handover position shown in FIG. 19, in which the transfer projections 514 project into the recesses of the output roller 410. Once the end of the tissue roll is inserted into the gap 420 between the upper rollers 410, and, in particular, when the output rollers 410 start rotating in order to supply tissue, the end of the tissue roll is released from in between the retainer flaps 520 and the transfer plate 510.

As can be seen, in particular, in FIGS. 8 and 18, a detector 700 detecting whether the second tissue position is empty is provided. In the example depicted, the detector 700 is in the form of an optical tissue sensor 710 for detecting the presence of a tissue connection between the second tissue roll position and the output mechanism 400. The optical tissue sensor 710 is covered with an infrared glass 711.

This optical sensor 710 detects whether a tissue connection 41 is present between a tissue roll in the second tissue roll position 129 and the output mechanism 400. In case such a tissue connection 41 is present, as shown in FIG. 18, the transfer mechanism 500 remains in the elevated service position as shown in FIG. 18, releasably holding the end of the tissue roll 100 in the first tissue roll position. Preferably, the transfer mechanism 500 is activated only when the detector 700 in the form of optical tissue sensor 710 detects that no tissue connection is present between the tissue roll in the second tissue roll position 129 and the output mechanism 400.

Preferably, a cutting unit 11 (see FIG. 8) is provided between the dispensing opening 12 and the output rollers 410 for cutting off portions of tissue from the continuous web of tissue. As can be seen in detail in FIG. 23, a cutting unit preferably comprises a blade 11*a*, a blade shield 11*b* and a blade cover 11*c*. A blade switch 453 is provided for detecting whether the blade 11*a* has been activated, which indicates that a user has taken a portion of tissue from the dispenser.

Further, preferably, a control unit 16 (see FIGS. 8, 23) is provided for performing various control functions to realize the various features described herein. The control unit 16 preferably comprises a microcontroller and further, preferably, performs all control functions necessary to operate the dispenser 1.

A user interface 15 with a user interface unit 19 and user interface sticker 17 provides information to a user. The status LED 18 can indicate a fault status, for example, to a user. Preferably, the user interface unit 19 does not comprise a microcontroller.

Further, preferably, the output mechanism 400 is an automatic output mechanism 400 which is activated by a signal from a proximity sensor 14 for detecting the presence of a user. A dispenser 1 with such a functionality can also be described as a non-touch dispenser.

Figure 9:
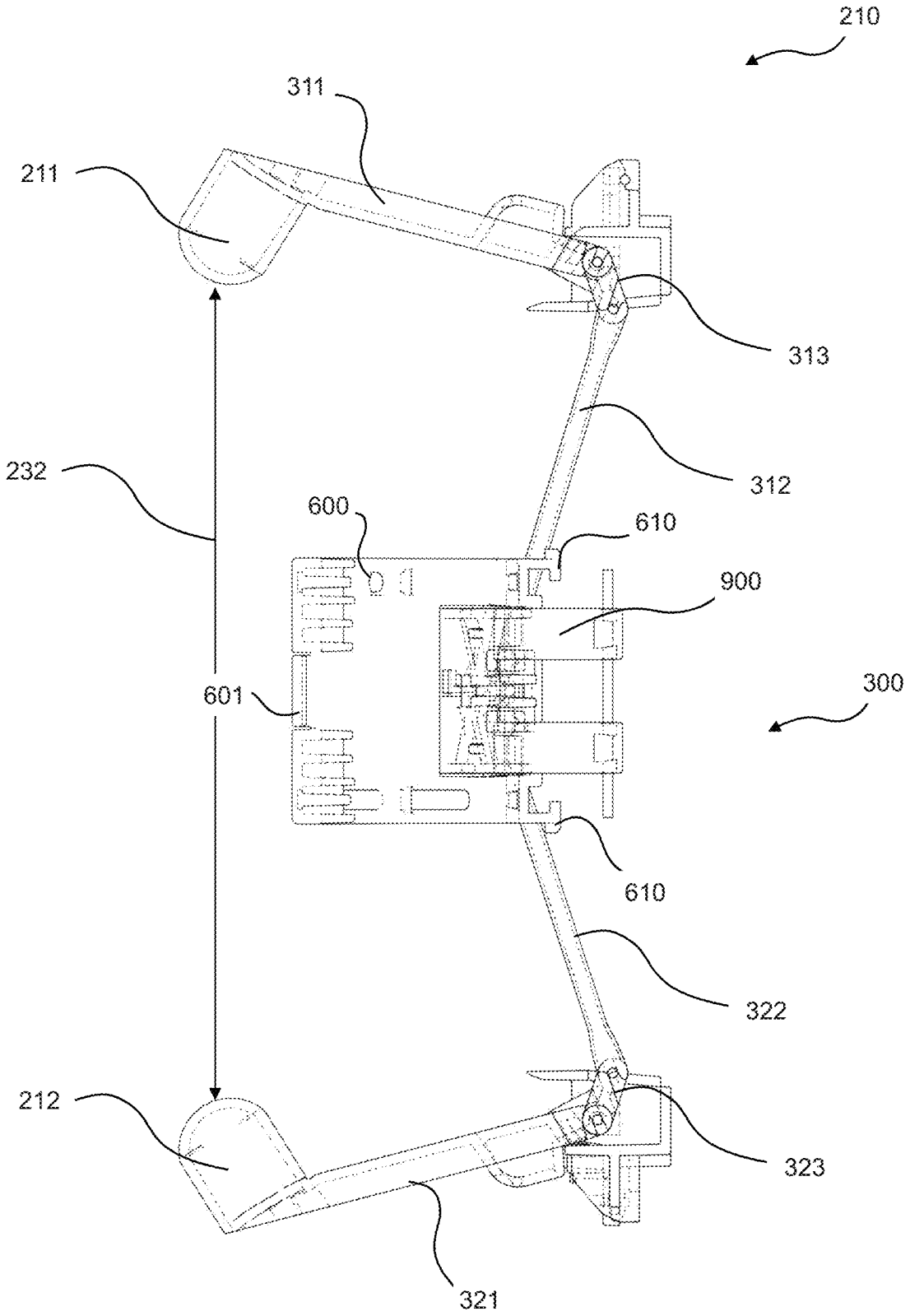
FIG. 9 is a top view of an exemplary embodiment of a holding arrangement in the release position.
Figure 10:
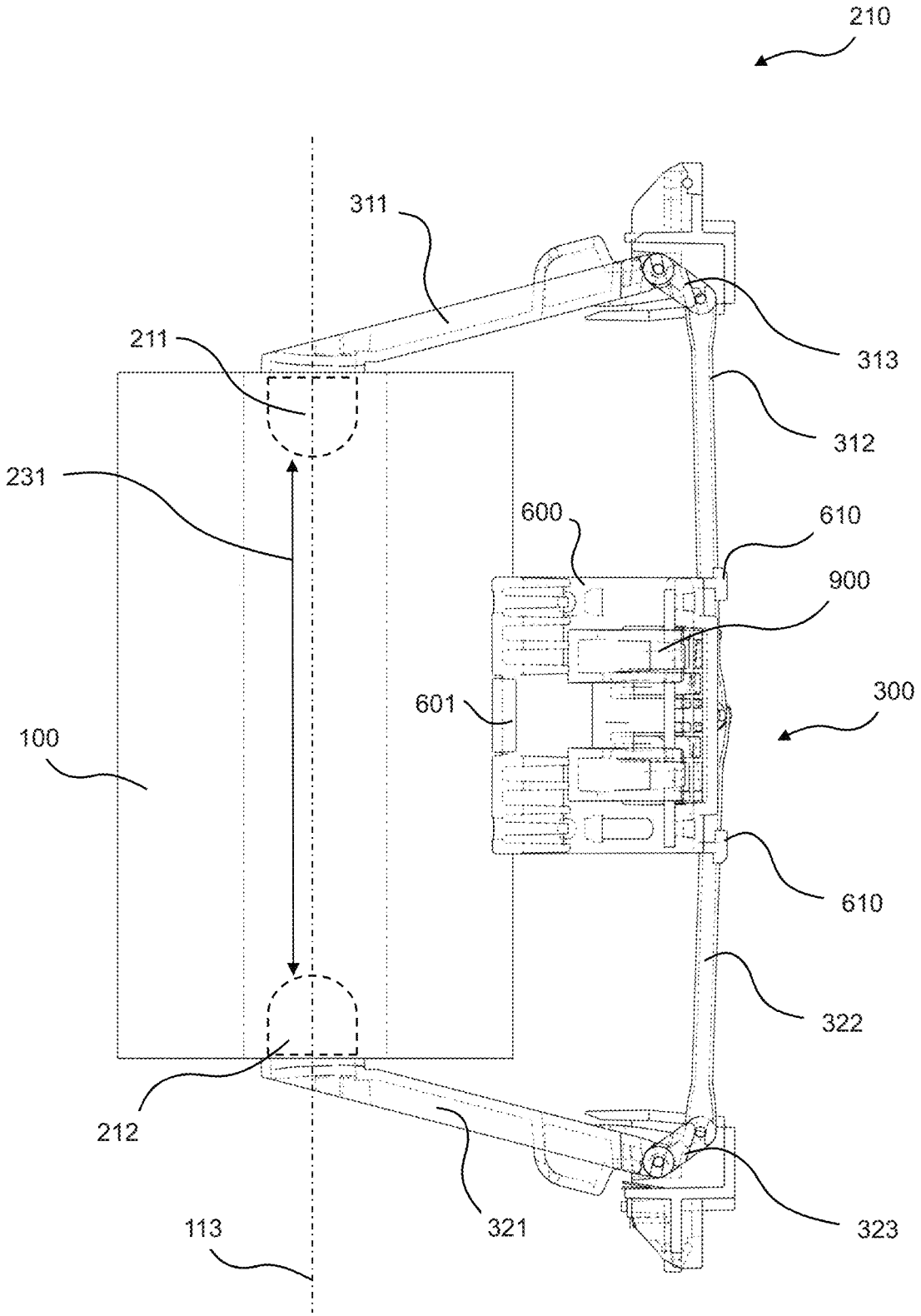
FIG. 10 is a top view of the holding arrangement in the hold position.

The dispenser 1 further features a holding arrangement 200 with a holding mechanism 210 comprising a first holding element 211 for engaging a first end of an axle 110 of the tissue roll 100 and a second holding element 212 for engaging a second end of an axle 110 of the tissue roll 100. The holding mechanism 210 is shown in more detail in FIGS. 9 and 10. As can be seen from these Figures in particular, a horizontal distance 232 in an axial direction of the tissue roll axis 113 between the first holding element 211 and the second holding element 212 in the release position is larger than a horizontal distance 231 in an axial direction of the tissue roll axis 113 in the hold position. In addition, these Figures show that the first and second holding elements 211, 212 are spaced from the axle 110 of the tissue roll 100 in the release position. In the hold position, however, the holding mechanism 210, in particular, the first and second holding arms 311, 321 and the first and second holding elements 211, 212 provide full operative support for the tissue roll 100 in the first tissue roll position during operation of the dispenser and, in particular, during supply of tissue from the tissue roll by unrolling the tissue roll in an unrolling direction about the tissue roll axis 113.

Figure 11:
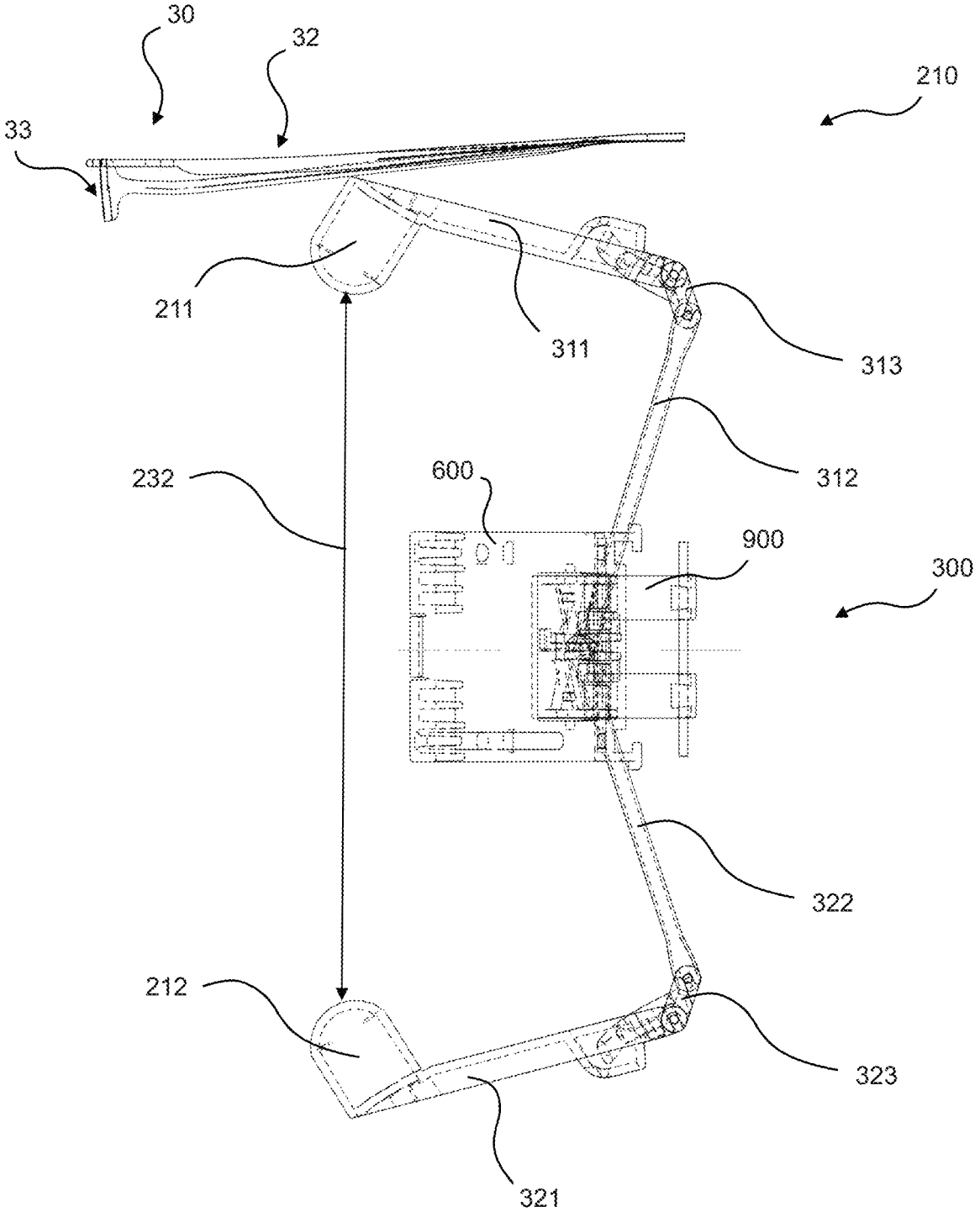
FIG. 11 is a top view of the holding arrangement according to FIG. 9 with a level indicator.
Figure 12:
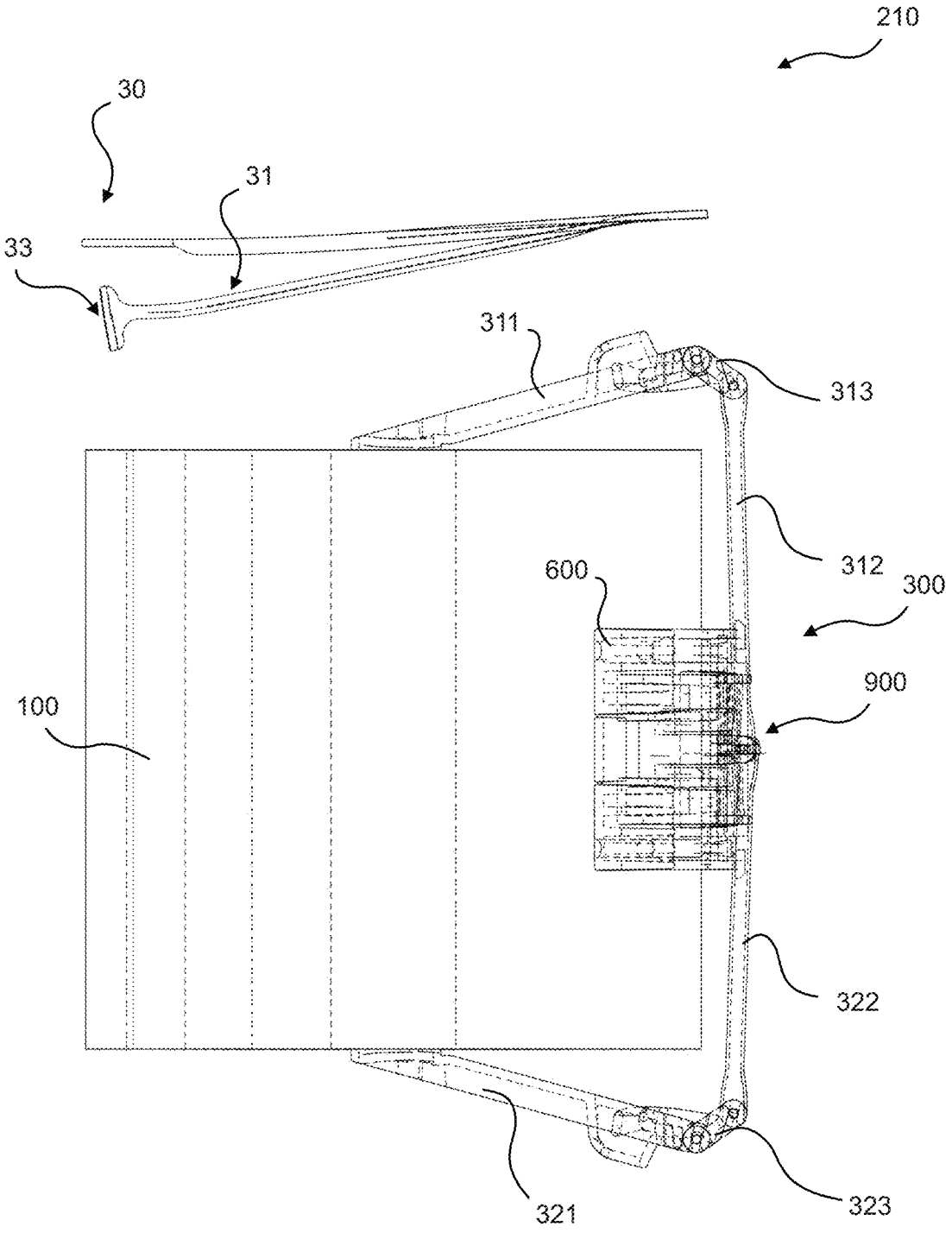
FIG. 12 is a top view of the holding arrangement according to FIG. 10 with a level indicator.
Figure 13:
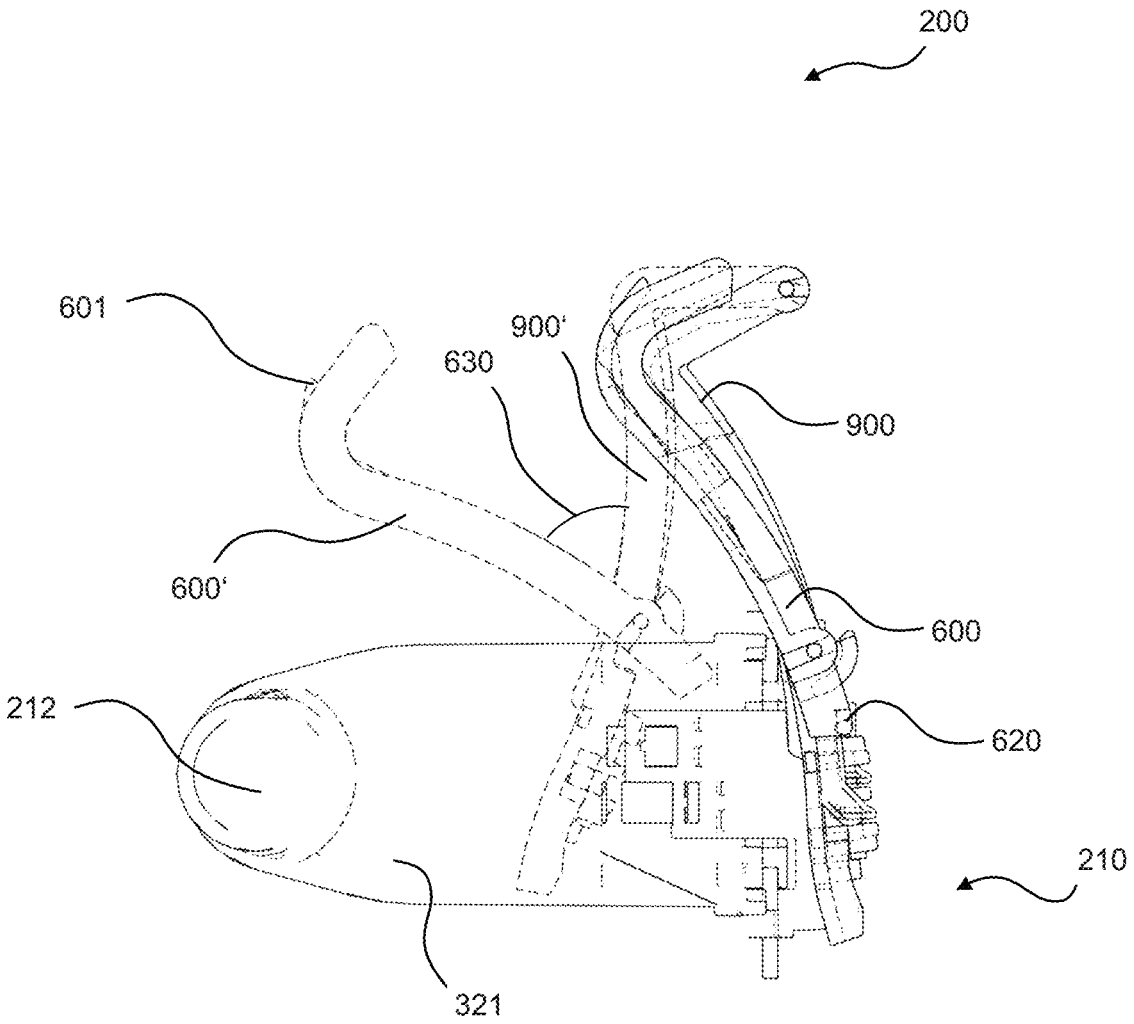
FIG. 13 is a side view of the holding arrangement according to FIG. 9 with the diameter sensor and the transition element in different positions.
Figure 14:
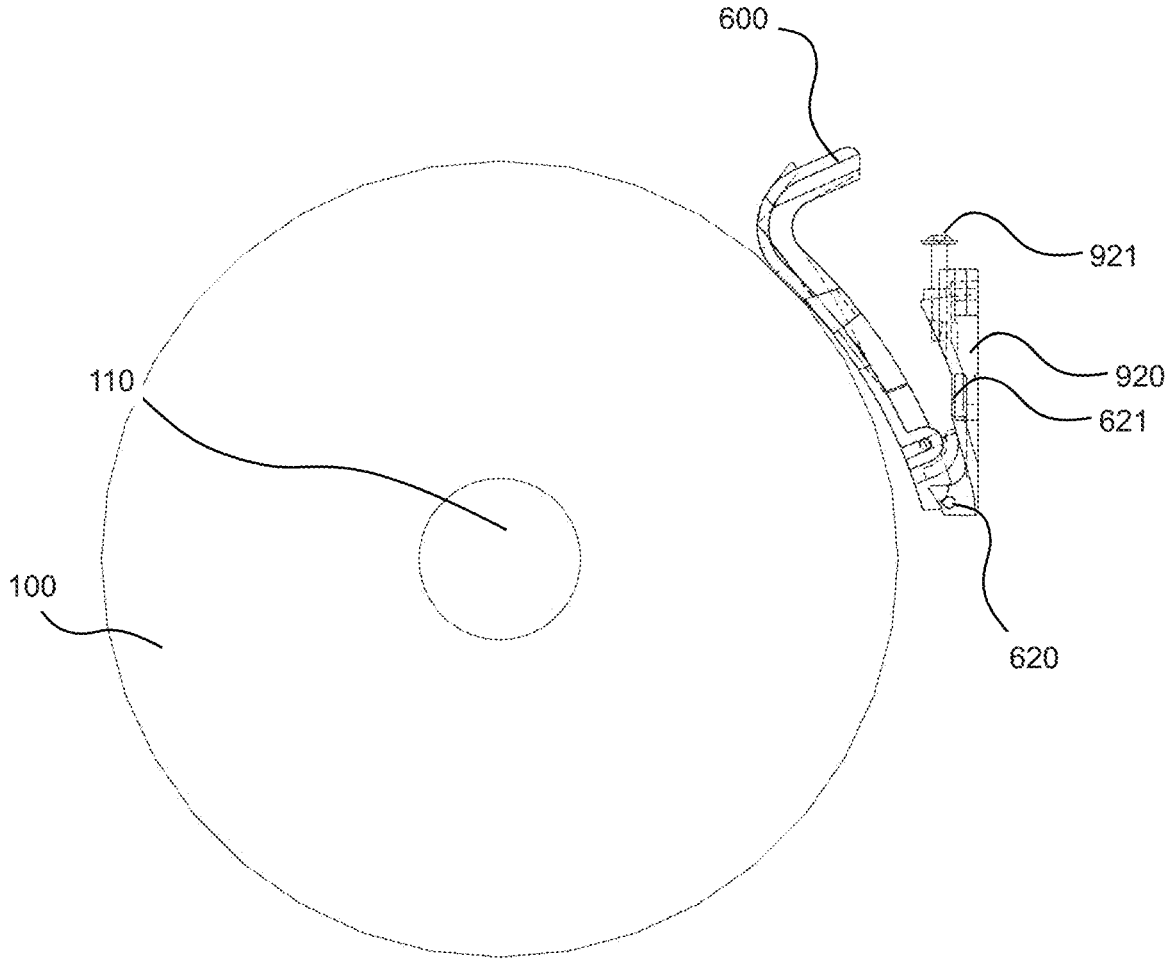
FIG. 14 is a full tissue roll with the diameter sensor.
Figure 15:
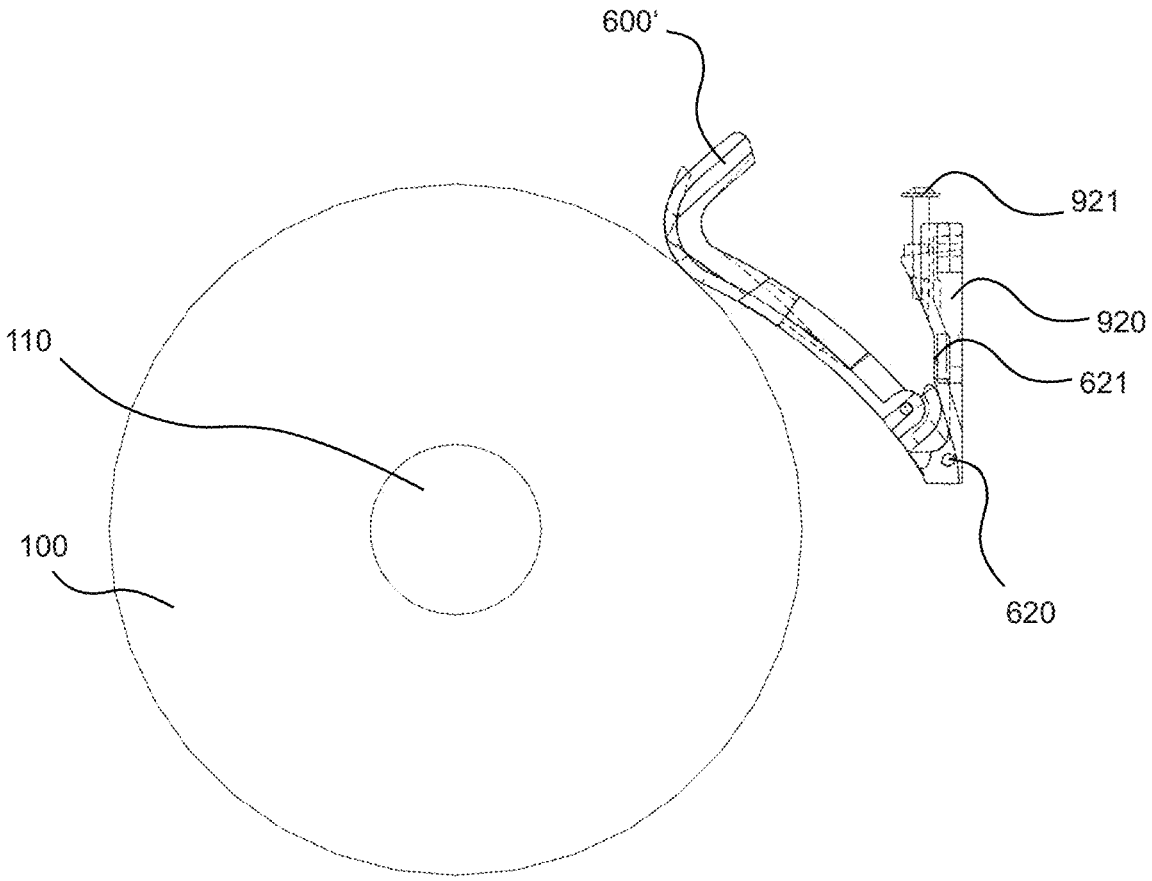
FIG. 15 is a reduced diameter tissue roll with the diameter sensor.
Figure 16:
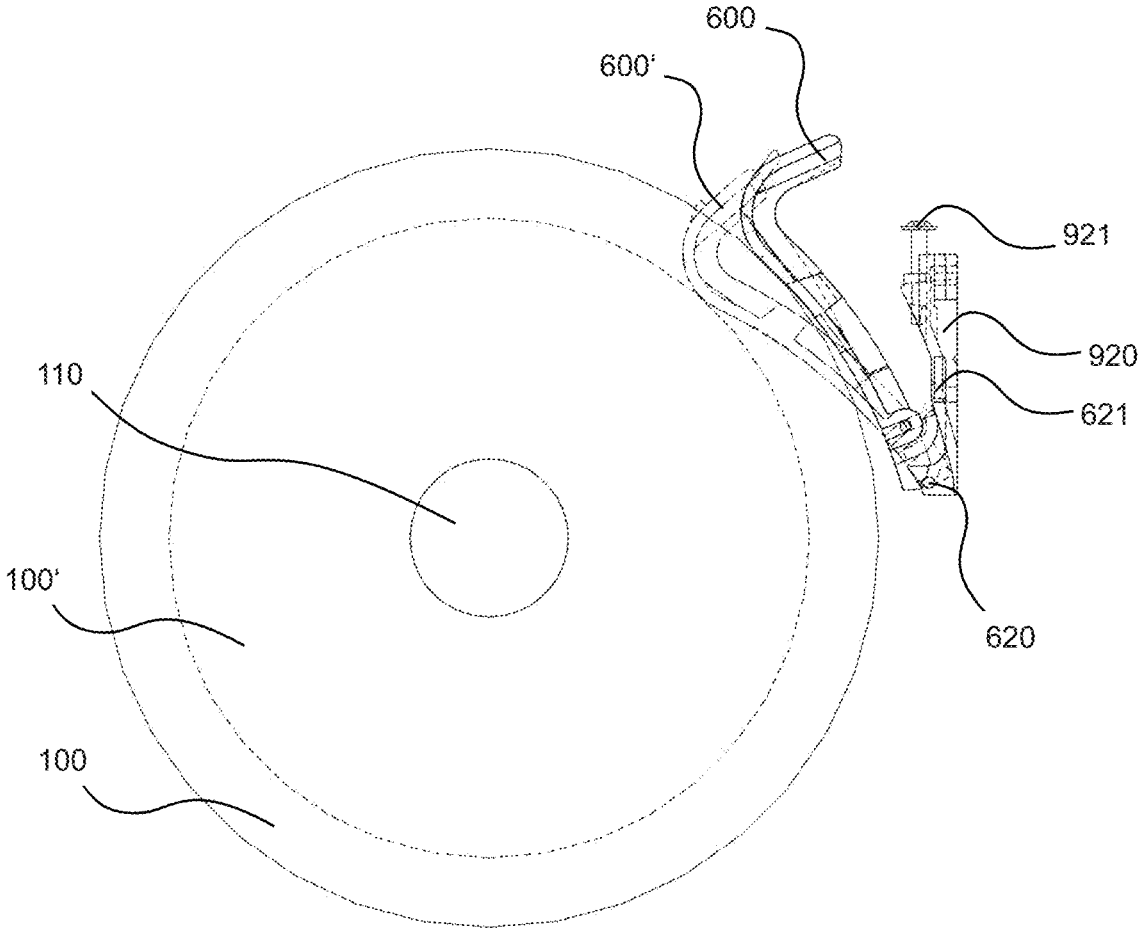
FIG. 16 depicts both the full and the reduced diameter tissue roll with the diameter sensor in different positions.
Figure 17:
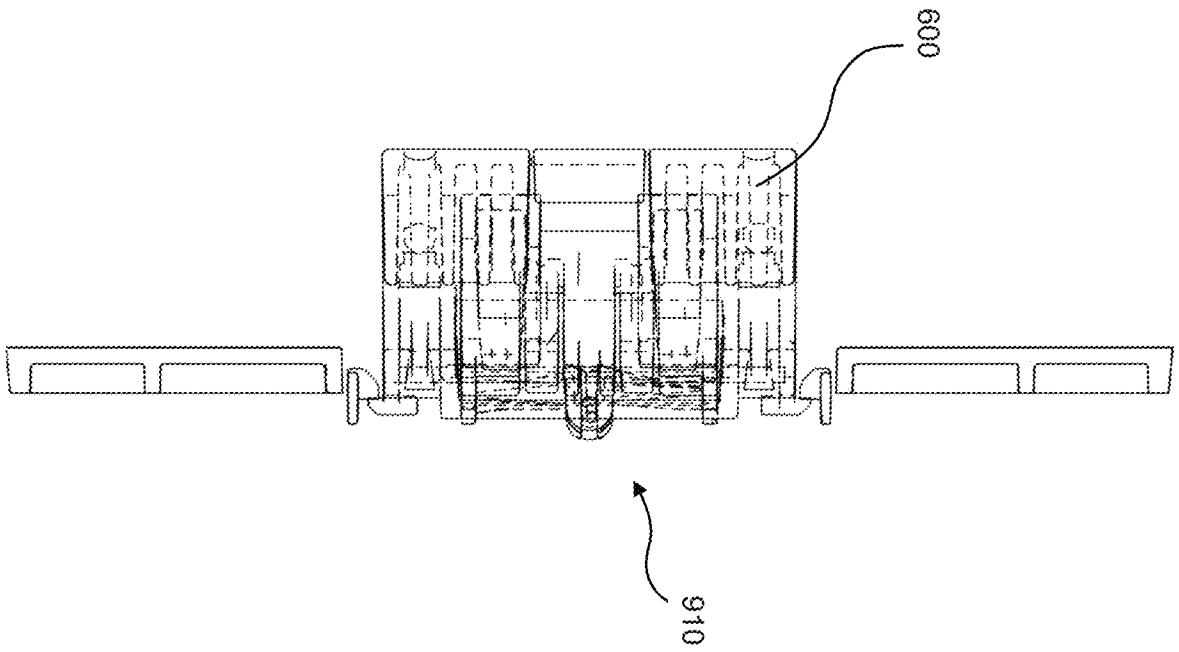
FIG. 17 is a top view of an exemplary embodiment of a support insert.

As can be seen from FIGS. 11 and 12, a level indicator 30 with a base arm 32 and a level arm 31 is provided. At one end of the level arm 31 an indication surface 33 is provided. As can be seen when comparing FIG. 11 and FIG. 12, the level arm 31 is moved by the first holding arm 311 and the first holding element 211 to an outer position corresponding to an empty position of the first tissue roll position, while the level arm 31 is biased in an inner, filled position when the holding mechanism 210 is in the hold position, as shown in FIG. 12.

The indication surface 33 is preferably viewable through the indicator opening 25 in the housing cover 22 such that service personnel can see through the indicator opening 25 whether or not there is a tissue roll 100 at the first tissue roll position, i.e., whether the holding mechanism 210 is in the hold position or in the release position without having to open the housing cover 22 of the dispenser 1.

The holding arrangement 200 further comprises a shift mechanism 300 for shifting the holding mechanism 210, in particular, the first and second holding elements 211, 212, from the hold position to the release position and vice versa. The shift mechanism 300 comprises a transition element 900, which is pivotably connected to a diameter sensor 600. The shift mechanism 300 is mounted on the housing base 21, preferably via the support insert 910. The shift mechanism 300 further comprises a toggle mechanism. In particular, the shift mechanism 300 further comprises first and second connection arms 312, 322 projecting from the transition element 900 and first and second transition pieces 313, 323 pivotably connecting the first and second holding arms 311, 321 to the first and second connection arms 312, 322.

The diameter sensor 600 is adapted to change its position with the changing, in particular, decreasing, diameter of the tissue roll 100, as can be seen in particular in FIGS. 13 through 16. Therein, the diameter sensor is shown in a full diameter position 600 and a reduced diameter position 600'. An angle 630 between the diameter sensor 600' and the transition element 900' in the release position is larger than the respective angle in the hold position. These Figures further show a guide frame 920 with a contoured guide surface 621, which can be adjusted by an adjustment element 921. A guide element 620 is provided on the diameter sensor 600. As can be seen, the diameter sensor 600 changes its position and the guide element 620 moves towards the contoured guide surface 621 and makes contact with it as the diameter of the tissue roll 100 decreases. Due to the contour of this guide surface 621, the guide element 620 slides along the guide surface 621 and effects an upward and lateral movement of the diameter sensor 600. This upward and lateral movement of the diameter sensor 600 effected by the interaction of the guide element 620 with the contoured guide surface 621 unlocks the locking element 610 of the diameter sensor.

The diameter sensor 600 has two locking elements 610 (see FIGS. 9 and 10, for example) for locking the diameter sensor 600 in the housing base 21, in particular, in a support insert 910 on the housing base 21. When the housing cover 22 and the first projection 23 thereon contacts the contact flip 601 on the diameter sensor 600, the locking elements 610 are snapped into their locked position in the support insert 910.

Once the locking elements 610 are unlocked by the upward and lateral movement of the diameter sensor 600 effected by the interaction of the guide element 620 with the contoured guide surface 621 in the reduced diameter position 600', the shift mechanism 300 shifts to hold mechanism 210 into the release position. In the release position, the tissue roll 100 is released from the first tissue roll position and falls into the second tissue roll position. In order to decelerate this movement, stoppers 71 can be provided, as depicted in FIG. 21.

Figure 22:
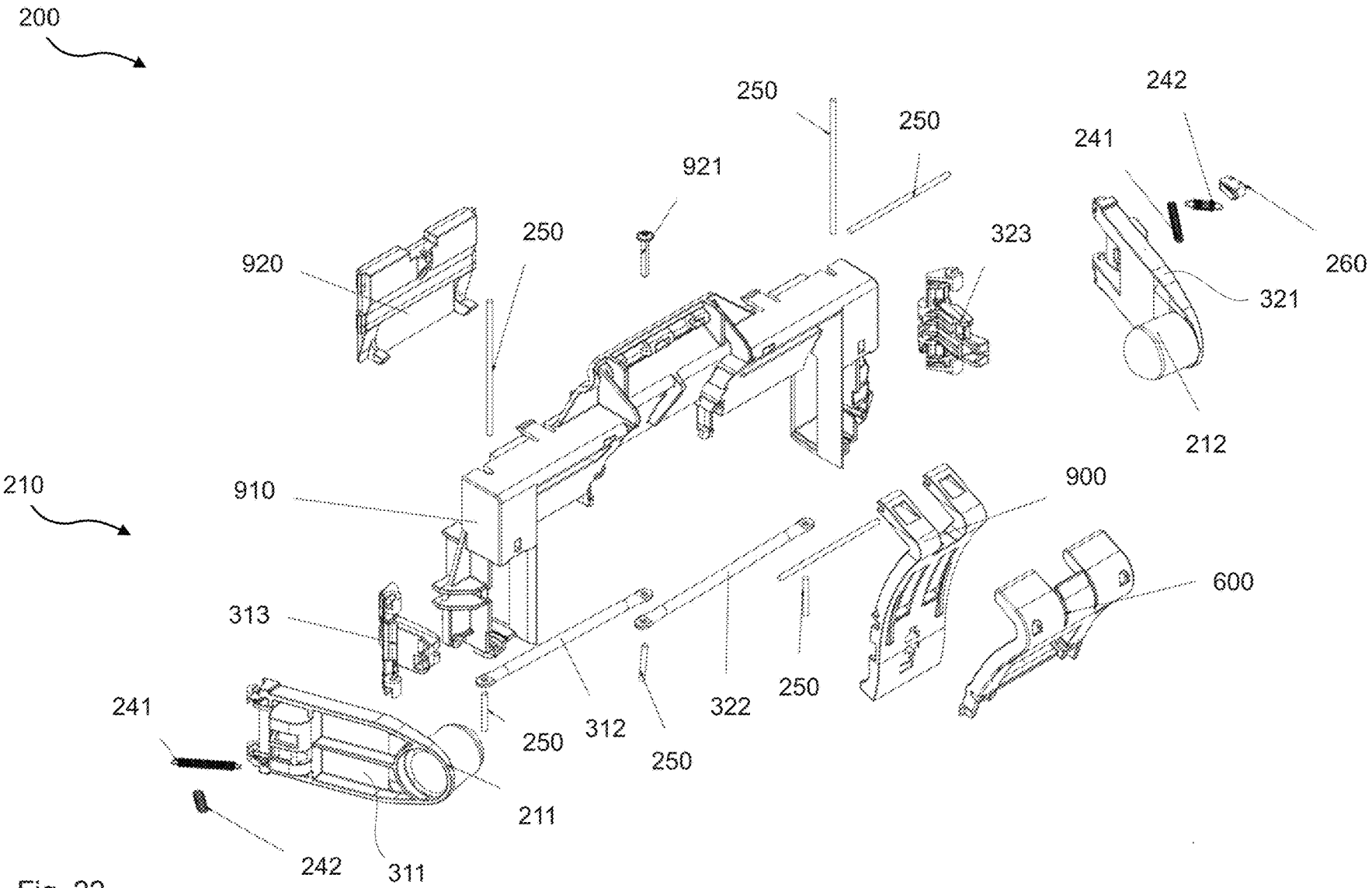
FIG. 22 is an exploded view of an embodiment of a holding arrangement.

The shift mechanism 300 is biased in the release position, by two first biasing elements 241 in the form of springs, which connect the first transition piece 313 and the second transition piece 323 to the support insert 910 (see FIG. 22). As can be further seen from FIG. 22, the first holding arm 311 is connected to the first transition piece 313 via a second biasing element 242 and also the second holding arm 321 is connected to the second transition piece 323 via a second biasing element 242. Both second biasing elements 242 are in the form of springs. Pins 250 are preferably used for connecting various components. The two second biasing elements 242 are dimensioned smaller than the first biasing elements 241 and exert less force than the at least one first biasing element 241 and into a different direction than the two first biasing elements 241 in order to brake or stop a movement initiated by the two first biasing elements 241. FIG. 22 further shows a number of pins for connecting the different elements of the holding arrangement 200.

A switch 260 is provided, which is generates a signal indicating whether the hold mechanism 210 is in the hold position of in the release position. This signal is transferred to the dispenser module via a connector 451. In particular, in can be preferred that the transfer mechanism cannot be activated as long as the switch 260 indicates that the hold mechanism 210 is in the release position.

In the release position, the diameter sensor 600 and the lower end of the transition element 900 are spaced from the housing base 21, in particular, the support insert 910. When a new tissue roll 100 is inserted into the first tissue roll position, the tissue roll 100 is pushed against the diameter sensor 600 and the transition element 900 and thus the shift mechanism 300 and the hold mechanism 210 are brought against the biasing force into the hold position and the locking elements 610 are locked, preferably in the support insert 910 and further snapped therein by pressure exerted by the first protrusion 23 on the housing cover 22 upon closing of the housing 2. The insertion of a new tissue roll into the first tissue roll position can be facilitated by providing lead wings 72, as depicted in FIG. 21.

In summary, a dispenser 1 is provided, featuring several advantages. By providing the output mechanism 400 and the transfer mechanism 500 together with the detector 700 for checking whether the second tissue roll position is empty, as described herein, a resource efficient solution is provided to transfer the end of a new referral tissue roll to the output mechanism only when the second tissue roll position is empty. Thus, double tissue usage is avoided.

Further, by providing a holding arrangement 200, as described herein, a very easy and time-saving service of the dispenser 1 is possible, while at the same time providing reliable and full operative support for the tissue in the hold position and allowing a freefall of the tissue roll from the release position to the second tissue roll position, whilst maintaining the tissue connection from the tissue roll to the output mechanism 400.

As soon as the tissue roll has been released from the first tissue roll position and has fallen into the second tissue roll position, the dispenser 1 can be provided with a new tissue roll by service personnel in the first tissue roll position regardless of the direction of unrolling. By inserting the end of the new refill tissue roll into the transfer mechanism, the dispenser 1 is ready for firstly completely using up the remaining tissue on the spare tissue roll in the second tissue roll position and subsequently transferring the end of the new refill tissue roll to the output mechanism automatically and without the need for service personnel or user interaction. Thus, the dispenser 1 is reliable, has a high dispensing capacity, and is resource, time, and cost efficient.

The invention claimed is:

1. A dispenser for dispensing portions of a continuous web of tissue from a tissue roll comprising a holding mechanism for holding the tissue roll in the dispenser, the dispenser comprising:

a second tissue roll position for receiving the tissue roll from a first tissue roll position;

the holding mechanism for holding a tissue roll in the first tissue roll position, wherein the holding mechanism comprises a first holding element for engaging a first end of an axle of the tissue roll and a second holding element for engaging a second end of the axle of the tissue roll;

a diameter sensor for detecting a diameter of the tissue roll in the first tissue roll position; and a shift mechanism connecting the holding mechanism and the diameter sensor;

wherein the shift mechanism is adapted for shifting the first and second holding elements of the holding mechanism from a hold position to a release position and vice versa;

wherein a distance between the first holding element and the second holding element in the release position is larger than a distance between the first holding element and the second holding element in the hold position;

wherein the shift mechanism is adapted for shifting the first and second holding elements of the holding mechanism from the hold position to the release position when the diameter sensor detects a reduced tissue roll diameter in the first tissue roll position;

wherein the first tissue roll position is a first dispensing position for dispensing tissue from the tissue roll and the first tissue roll position is a receiving position for receiving a new tissue roll;

wherein the first holding element is horizontally or axially spaced from the first end of the axle of the tissue roll in the release position and the second holding element is horizontally or axially spaced from the second end of the axle of the tissue roll in the release position and the holding mechanism remains substantially within the same horizontal plane in the hold position and in the release position;

wherein the shift mechanism extends in a substantially horizontal plane in the release position and in the hold position and is arranged such that a movement of the shift mechanism from the hold position to the release position and vice versa is substantially horizontal;

wherein the holding mechanism is arranged such that a movement of the first holding element and the second holding element of the holding mechanism from the hold position to the release position and vice versa is substantially horizontal, and the first holding element and the second holding element are adapted to provide operative support for the tissue roll during operation of the dispenser to dispense a portion of the continuous web of tissue;

wherein the first holding element and the second holding element of the holding mechanism is biased in the release position; and wherein the shift mechanism comprises at least one first biasing element biasing the holding mechanism in the release position.

2. The dispenser pursuant to claim 1, wherein:

the shift mechanism is adapted for shifting the first and second holding elements of the holding mechanism from the release position to the hold position when the diameter sensor detects a full tissue roll diameter in the first tissue roll position.

3. A dispenser for dispensing portions of a continuous web of tissue from a tissue roll comprising a holding mechanism for holding the tissue roll in the dispenser, the dispenser comprising:

a second tissue roll position for receiving the tissue roll from a first tissue roll position;

the holding mechanism for holding a tissue roll in the first tissue roll position, wherein the holding mechanism comprises a first holding element for engaging a first end of an axle of the tissue roll and a second holding element for engaging a second end of the axle of the tissue roll;

a diameter sensor for detecting a diameter of the tissue roll in the first tissue roll position; and a shift mechanism connecting the holding mechanism and the diameter sensor;

wherein the shift mechanism is adapted for shifting the first and second holding elements of the holding mechanism from a hold position to a release position and vice versa;

wherein a distance between the first holding element and the second holding element in the release position is larger than a distance between the first holding element and the second holding element in the hold position;

wherein the shift mechanism is adapted for shifting the first and second holding elements of the holding mechanism from the hold position to the release position when the diameter sensor detects a reduced tissue roll diameter in the first tissue roll position;

wherein the shift mechanism comprises a transition element pivotably connected to the diameter sensor;

wherein the diameter sensor comprises a locking element for locking the holding mechanism in the hold position and for locking the diameter sensor to a housing of a dispenser, and the diameter sensor comprises a guide element for activating the shift mechanism by unlocking the locking element; and wherein the guide element is adapted to engage a guide frame of the dispenser.

4. The dispenser pursuant to claim 3, wherein:

the diameter sensor is adapted to change its position with a changing diameter of the tissue roll in the first tissue roll position and is adapted to rest upon an outer periphery of the tissue roll in the first tissue roll position;

the transition element is adapted to rest upon an outer periphery of the tissue roll;

the diameter sensor or the transition element change their relative position to each other with a changing diameter of the tissue roll in the first tissue roll position, wherein an angle between the diameter sensor and the transition element is larger in the release position of the holding mechanism or in the free position of the transition element than in the hold position of the holding mechanism or in the locked position of the transition element, respectively; and the guide element or the locking element of the diameter sensor can be adjusted.

5. A dispenser for dispensing portions of a continuous web of tissue from a tissue roll comprising a holding mechanism for holding the tissue roll in the dispenser, the dispenser comprising:

a second tissue roll position for receiving the tissue roll from a first tissue roll position;

the holding mechanism for holding a tissue roll in the first tissue roll position, wherein the holding mechanism comprises a first holding element for engaging a first end of an axle of the tissue roll and a second holding element for engaging a second end of the axle of the tissue roll;

a diameter sensor for detecting a diameter of the tissue roll in the first tissue roll position; and a shift mechanism connecting the holding mechanism and the diameter sensor;

wherein the shift mechanism is adapted for shifting the first and second holding elements of the holding mechanism from a hold position to a release position and vice versa;

wherein a distance between the first holding element and the second holding element in the release position is larger than a distance between the first holding element and the second holding element in the hold position;

wherein the shift mechanism is adapted for shifting the first and second holding elements of the holding mechanism from the hold position to the release position when the diameter sensor detects a reduced tissue roll diameter in the first tissue roll position;

wherein the shift mechanism comprises a toggle mechanism;

wherein the shift mechanism comprises a first connection arm projecting from the diameter sensor, a first holding arm projecting from the first holding element, a first transition piece pivotably connecting the first holding arm and the first connection arm, a second connection arm projecting from the diameter sensor, a second holding arm projecting from the second holding element, and a second transition piece pivotably connecting the second holding arm and the second connection arm;

wherein the first transition piece or the second transition piece are connected to the support insert via at least one first biasing element; and wherein the first holding arm is connected to the first transition piece via at least one second biasing element or the second holding arm is connected to the second transition piece via at least one second biasing element.

6. The dispenser pursuant to claim 5, wherein:

one or both of the first holding element and the second holding element is exchangeable;

one or both of the first holding element and the second holding element is variable with respect to form or shape or by adding, removing, or shifting variation elements;

one or both of the first holding element and the first holding arm is releasably connected to the shift mechanism or the second holding element or the second holding arm is releasably connected to the shift mechanism; and the first holding arm is releasably connected to the first transition piece or the first connection arm or the second holding arm is releasably connected to the second transition piece or the second connection arm.

7. A dispenser for dispensing portions of a continuous web of tissue from a tissue roll comprising a holding mechanism for holding the tissue roll in the dispenser, the dispenser comprising:

a second tissue roll position for receiving the tissue roll from a first tissue roll position;

the holding mechanism for holding a tissue roll in the first tissue roll position, wherein the holding mechanism comprises a first holding element for engaging a first end of an axle of the tissue roll and a second holding element for engaging a second end of the axle of the tissue roll;

a diameter sensor for detecting a diameter of the tissue roll in the first tissue roll position; and a shift mechanism connecting the holding mechanism and the diameter sensor;

wherein the shift mechanism is adapted for shifting the first and second holding elements of the holding mechanism from a hold position to a release position and vice versa;

wherein a distance between the first holding element and the second holding element in the release position is larger than a distance between the first holding element and the second holding element in the hold position;

wherein the shift mechanism is adapted for shifting the first and second holding elements of the holding mechanism from the hold position to the release position when the diameter sensor detects a reduced tissue roll diameter in the first tissue roll position;

wherein the first holding element comprises a first captive piece for interaction with a part of the tissue roll or the second holding element comprises a second captive piece for interaction with a part of the tissue roll;

wherein the first holding element comprises a first identification element for identifying the tissue roll or the second holding element comprises a second identification element for identifying the tissue roll; and wherein the first holding element comprises a first form fit piece for engaging the axle or an axle cap of the tissue roll in a form fit or the second holding element comprises a second form fit piece for engaging the axle or the axle cap of the tissue roll.

8. A dispenser for dispensing portions of a continuous web of tissue from a tissue roll comprising a holding mechanism for holding the tissue roll in the dispenser, the dispenser comprising a second tissue roll position for receiving the tissue roll from a first tissue roll position;

the holding mechanism for holding a tissue roll in the first tissue roll position, wherein the holding mechanism comprises a first holding element for engaging a first end of an axle of the tissue roll and a second holding element for engaging a second end of the axle of the tissue roll;

a diameter sensor for detecting a diameter of the tissue roll in the first tissue roll position; and a shift mechanism connecting the holding mechanism and the diameter sensor;

a housing with an openable housing cover and a housing base for wall-mounting the dispenser;

a dispensing opening;

a cutting unit;

a control unit;

a user interface;

a proximity sensor for detecting the presence of a user;

an output mechanism comprising at least two output rollers, including a driven roller and tension roller; and a transfer mechanism for releasably holding and transferring an end of a tissue roll in the first tissue roll position to the output mechanism;

wherein the shift mechanism is adapted for shifting the first and second holding elements of the holding mechanism from a hold position to a release position and vice versa;

wherein a distance between the first holding element and the second holding element in the release position is larger than a distance between the first holding element and the second holding element in the hold position;

wherein the shift mechanism is adapted for shifting the first and second holding elements of the holding mechanism from the hold position to the release position when the diameter sensor detects a reduced tissue roll diameter in the first tissue roll position; and wherein the transfer mechanism is adapted to transfer the end of the tissue roll in the first tissue roll position to the output mechanism when the second tissue roll position is empty.

9. The dispenser pursuant to claim 8, wherein the housing cover comprises a first protrusion adapted to contact a contact flap of the diameter sensor when the housing is closed.

10. A dispenser for dispensing portions of a continuous web of tissue from a tissue roll comprising a holding mechanism for holding the tissue roll in the dispenser, the dispenser comprising:

a second tissue roll position for receiving the tissue roll from a first tissue roll position;

the holding mechanism for holding a tissue roll in the first tissue roll position, wherein the holding mechanism comprises a first holding element for engaging a first end of an axle of the tissue roll and a second holding element for engaging a second end of the axle of the tissue roll;

a diameter sensor for detecting a diameter of the tissue roll in the first tissue roll position; and a shift mechanism connecting the holding mechanism and the diameter sensor; and a level indicator having a filled position and an empty position, wherein the level indicator is adapted such that the level indicator is in its filled position when the holding mechanism is in its hold position and the level indicator is in its empty position when the holding mechanism is in its release position;

wherein the shift mechanism is adapted for shifting the first and second holding elements of the holding mechanism from a hold position to a release position and vice versa;

wherein a distance between the first holding element and the second holding element in the release position is larger than a distance between the first holding element and the second holding element in the hold position; and wherein the shift mechanism is adapted for shifting the first and second holding elements of the holding mechanism from the hold position to the release position when the diameter sensor detects a reduced tissue roll diameter in the first tissue roll position.

11. A dispenser for dispensing portions of a continuous web of tissue from a tissue roll comprising a holding mechanism for holding the tissue roll in the dispenser, the dispenser comprising:

a second tissue roll position for receiving the tissue roll from a first tissue roll position;

the holding mechanism for holding a tissue roll in the first tissue roll position, wherein the holding mechanism comprises a first holding element for engaging a first end of an axle of the tissue roll and a second holding element for engaging a second end of the axle of the tissue roll;

a diameter sensor for detecting a diameter of the tissue roll in the first tissue roll position;

a shift mechanism connecting the holding mechanism and the diameter sensor; and a tissue roll axle receptacle, wherein the tissue roll axle receptacle is openable and is pivotably connected to the housing base;

wherein the tissue roll axle receptacle is open when the housing cover is open and comprises a retention element retaining the tissue roll axle when the tissue roll axle receptacle is open;

wherein the shift mechanism is adapted for shifting the first and second holding elements of the holding mechanism from a hold position to a release position and vice versa;

wherein a distance between the first holding element and the second holding element in the release position is larger than a distance between the first holding element and the second holding element in the hold position; and wherein the shift mechanism is adapted for shifting the first and second holding elements of the holding mechanism from the hold position to the release position when the diameter sensor detects a reduced tissue roll diameter in the first tissue roll position.

12. A dispenser for dispensing portions of a continuous web of tissue from a tissue roll comprising a holding mechanism for holding the tissue roll in the dispenser, the dispenser comprising:

a second tissue roll position for receiving the tissue roll from a first tissue roll position;

the holding mechanism for holding a tissue roll in the first tissue roll position, wherein the holding mechanism comprises a first holding element for engaging a first end of an axle of the tissue roll and a second holding element for engaging a second end of the axle of the tissue roll;

a diameter sensor for detecting a diameter of the tissue roll in the first tissue roll position; and a shift mechanism connecting the holding mechanism and the diameter sensor;

wherein the shift mechanism is adapted for shifting the first and second holding elements of the holding mechanism from a hold position to a release position and vice versa;

wherein a distance between the first holding element and the second holding element in the release position is larger than a distance between the first holding element and the second holding element in the hold position;

wherein the shift mechanism is adapted for shifting the first and second holding elements of the holding mechanism from the hold position to the release position when the diameter sensor detects a reduced tissue roll diameter in the first tissue roll position;

wherein the first tissue roll position and the second tissue roll position comprise an axle opening through which the axle of the tissue roll can pass; and wherein a stop element is provided for stopping the axle of the tissue roll from passing the axle opening, wherein the stop element is arranged to let the axle of the tissue roll pass through the axle opening when a further tissue roll enters the first tissue roll position or the second tissue roll position.

* * * * *